US006158150A

United States Patent [19]

Morris et al.

[11] Patent Number: 6,158,150

[45] Date of Patent: Dec. 12, 2000

[54] LONGITUDINAL GRIND PLATE

[75] Inventors: Christopher H. Morris, Topanga; David G. Inman, Fullerton, both of Calif.

[73] Assignee: Artemis Innovations Inc., Torrance, Calif.

[21] Appl. No.: 09/333,612

[22] Filed: Jun. 15, 1999

Related U.S. Application Data

[60] Division of application No. 08/890,595, Jul. 9, 1997, Pat. No. 6,006,451, which is a continuation-in-part of application No. 08/799,062, Feb. 10, 1997, Pat. No. 5,970,631

[60] Provisional application No. 60/022,318, Jul. 23, 1996.

[51] Int. Cl.[7] ..... A43B 5/00; A43B 13/22; A43B 13/28

[52] U.S. Cl. ..... 36/115; 36/132; 36/103; 36/136; 36/75 R

[58] Field of Search ..... 36/132, 115, 114, 36/107, 72 A, 73, 108, 25 R, 148, 149, 152, 103, 116, 133, 136, 7.1 R, 76 R, 76 C, 72 R, 72 B, 75 R, 75 A, 82

[56] References Cited

U.S. PATENT DOCUMENTS

| | | | |
|---|---|---|---|
| 234,030 | 11/1880 | Hadley et al. . | |
| 579,577 | 3/1897 | Hansom . | |
| 702,476 | 6/1902 | Price . | |
| 875,560 | 12/1907 | Vaughan . | |
| 881,079 | 3/1908 | Jolitz . | |
| 892,152 | 6/1908 | Harman . | |
| 1,056,091 | 3/1913 | Dickson . | |
| 1,189,329 | 7/1916 | Winagle . | |
| 1,260,901 | 3/1918 | Hayhurst . | |
| 1,428,232 | 9/1922 | Holmen . | |
| 1,592,692 | 7/1926 | Hackett . | |
| 1,636,909 | 7/1927 | Haney . | |
| 1,984,989 | 12/1934 | Reed . | |
| 2,113,477 | 4/1938 | Gilman . | |
| 2,114,461 | 4/1938 | Agosta . | |
| 2,138,823 | 12/1938 | Werkman . | |
| 2,484,935 | 10/1949 | De Rooy . | |
| 2,572,671 | 10/1951 | Shaw . | |
| 3,027,661 | 4/1962 | McCord | 36/91 |
| 3,032,894 | 5/1962 | Kennedy et al. | 36/91 |
| 3,486,250 | 12/1969 | Purtle . | |
| 3,789,523 | 2/1974 | Rubin . | |
| 5,134,791 | 8/1992 | Gregory . | |
| 5,319,866 | 6/1994 | Foley . | |
| 5,410,821 | 5/1995 | Hilgendorf . | |
| 5,425,186 | 6/1995 | Hoyt . | |

FOREIGN PATENT DOCUMENTS

| | | |
|---|---|---|
| 1138194 | 12/1982 | Canada . |
| 1239017 | 7/1988 | Canada . |
| D. 296 13 508 U1 | 11/1985 | Germany . |
| 117176 | 7/1918 | United Kingdom . |
| 216903 | 1/1925 | United Kingdom . |
| PCT/US97/11652 | 7/1997 | WIPO . |

*Primary Examiner*—Paul T. Sewell
*Assistant Examiner*—Anthony Stashick
*Attorney, Agent, or Firm*—Fulwider Patton Lee & Utecht, LLP

[57] ABSTRACT

An article of athletic footwear with a sole incorporating low friction surfaces for sliding across a protruding feature on a supporting surface and walking surfaces for other athletic pursuits, and a method of making same.

49 Claims, 11 Drawing Sheets

LONGITUDINAL GRIND PLATE

This application is a divisional application of co-pending application, Ser. No. 08/890,595, filed on Jul. 9, 1997, now U.S. Pat. No. 6,006,451, which is a continuation-in-part of application Ser. No. 08/799,062, filed Feb. 10, 1997, now U.S. Pat. No. 5,970,631, claiming priority of Provisional Application Ser. No. 60/022,318, filed on Jul. 23, 1996, each of which is hereby incorporated by reference.

FIELD OF THE INVENTION

The invention relates to footwear and particularly to footwear utilized in grinding activities.

DESCRIPTION OF THE PRIOR ART

The sport of grinding finds its origins with skateboarding and in-line skating. Early on skateboarding and in-line skate enthusiasts discovered a popular maneuver wherein the underside of the skateboard or in-line skate could be slid or skidded along an underlying surface, such as the edge of a curb or pipe rail, to skid the foot transversely without contact of the skateboard or skate wheel with the support surface. As this maneuver gained in popularity, it was discovered there was a need for shoes which could be utilized for everyday walking and running activities but yet which would allow the wearer to participate in grinding activities. It was this apparatus to which our parent application, U.S. Ser. No. 08/677,532, filed Jul. 10, 1997, and now pending, was directed.

As noted in my prior application, while there has been many efforts over the years to devise shoe apparatus for reinforcing the arch of the shoe sole to provide support for the arch and to enhance comfort of the user in climbing and standing on ladders or to allow dancers to execute sliding or gliding maneuvers across the dance floor, such devices have not gained popularity in the athletic field for grinding. Examples of prior art efforts in this area include the following devices.

Athletic pursuits have long been a popular and pleasurable pastime, favored by young and old alike as an integral part of a healthy lifestyle. The number and variety of sports being played have increased steadily throughout the ages, and have seen an especially marked rise in the past two decades that has been fueled, at least in part, by substantial advances in equipment technology. For the great majority of athletic activities, the single most important piece of equipment is comprised of the footwear worn by engaging in the particular sport.

Athletic footwear is currently available in a bewildering array of styles, each specifically adapted for a particular use and ranging from lightweight, high traction running shoes to rigid, protective ski boots. More practical footwear is also available in many choices, from comfortable shoes for walking over extended periods of time to heavily insulated and reinforced work boots. Some articles of footwear are designed to facilitate a variety of activities such as running, walking, jumping and skateboarding.

Skateboards consist of four wheels mounted on a semi-rigid board in a box configuration. The boards combine the excitement of skating with the mobility of running by enabling recreational access to a wide variety of surfaces and allowing the user to traverse sidewalks, roads, and other rollable surfaces. Highly athletic youthful users have discovered a relatively new use for skateboards. It has been discovered that the configuration of the skateboard also allows skaters to slide sideways across a protruding feature on a supporting surface, such as an edge, a ridge, a curb, a handrail, a pipe or the like, by engaging the underside of the board with, for instance, a pipe rail and then sliding laterally or longitudinally along the rail. Popularly referred to as "grinding", this is an exciting acrobatic maneuver that greatly increases the enjoyment of skateboarding by expanding the options available in using them.

As noted above, grinding maneuvers do not engage the wheels of the skateboard directly but rather the underside of the board, which is typically made of wood or hard plastic. These materials offer the requisite low coefficient of friction which enables the sliding maneuver across an abrasive surface such as a concrete curb. On the other hand, hard surface athletic footwear, such as running shoes, typically incorporate high friction cushioned soles that greatly aid in walking or running but inhibit sliding movements. More recently, other sports such as in-line skating and snowboarding have evolved to utilize grinding maneuvers. Unfortunately in order to perform grinding maneuvers with skateboards, in-line skates and snowboards, users must have a relatively high level of expertise. Furthermore, since skateboards, in-line skates and snowboards are rather bulky, they are not convenient to carry around and are often unacceptable in everyday settings, such as office, bus, etc. Therefore, although enjoyable and exciting, grinding currently requires a high level of skill accompanied with specialized equipment adaptable in limited circumstances.

The idea of sliding across a surface while standing upright is not new and various inventors have endeavored in the past to capitalize on this idea by proposing various devices to enable one to engage in this activity. One such device is built from a low friction material and attached to the sole of the shoe in the arch region, thereby allowing the user to slide across a smooth flat surface such as a dance floor. The device may extend below the heel of the shoe and leaves the forefoot area exposed so that the user may engage the floor with the sole to be able to push off into a sliding maneuver. A device of this type is disclosed in U.S. Pat. No. 2,572,671 to Shaw. Another shoe that has been proposed incorporates a low friction region protruding centrally from the sole with high friction areas surrounding this protuberance. The user can thus engage the supporting surface by tiling the foot to lower the high friction areas of the sole and can slide by pushing off and balance on the protruding area. U.S. Pat. No. 1,984,989 to Reed discloses a device of this type. Both of the devices described above are designed for use on flat, smooth surfaces, such as dance floors and neither device lends itself to use with a normal walking or running gait. Thus, although well adapted for their intended use as dance footwear, these devices are of limited usefulness and are not the ideal solution for persons desiring to engage in grinding activities.

Shoes have also been proposed with exterior metal support but without concern for sliding over a rail or the like. Prior art footwear of this type is typically equipped with different types of reinforced arch supports, often in the form of plates attached to the bottom surface of the sole in the arch region for gripping a tool such as a shovel or a ladder rung. Devices of this type are disclosed in, among others, U.S. Pat. Nos. 881,079 to Jolitz and 5,134,791 to Gregory. Such devices are designed to support the user's foot while engaging in labor intensive activities such as digging or climbing a ladder and are intended to restrict sliding on the support surface and to distribute shock. These plates are generally manufactured from a metal such as steel, and therefore provide an incidental and highly limited capacity for sliding on rough surfaces such as curb corners and the like.

SUMMARY OF THE INVENTION

The grind apparatus of the present invention is characterized by a shoe having a sole formed in the bottom side with transverse and longitudinally extending, downwardly opening recesses for receipt of a grind plate device including a transverse grind plate section curved upwardly at one or the other or both of the transverse edges. A longitudinal grind plate section projects longitudinally from the arch section and is recessed upwardly in the longitudinal recess.

In some embodiments, the longitudinal plate section is somewhat flexible to accommodate walking by the wearer. In some revocations, the longitudinal plate extends all the way to the toe, all the way to the heel, or both, from the back of the heel to the front of the toe area.

Typically, the present invention is incorporated in an athletic shoe having cushioned forefoot and heel sections comparable to basketball or tennis shoes.

Other features and advantages of the invention will become apparent from the following detailed description, taken in conjunction with the accompanying drawings, which illustrate, by way of example, the features of the invention.

DETAILED DESCRIPTION OF THE PREFERRED EMBODIMENTS

Skateboarding offers users a wide range of acrobatic maneuvers that can be performed. One such maneuver involves the skater leaping, stepping or jumping onto a protruding feature of a supporting surface, such as a rail, to engage with the underside of the board with such support surface to slide along the protuberance in a sideways or forward stance. The maneuver, commonly known as "grinding," is practiced for fun and sport by numerous skaters and has gained much recent popularity. More recently in-line skating and snowboarding have evolved to utilize grinding maneuvers. Unfortunately, at the present time the maneuver can only be performed by athletes equipped with skateboards, in-line skates, or snowboards and therefore the availability of performing the maneuver is restricted to a limited number of persons on a limited number of occasions.

The apparatus of the present invention solves the aforementioned problem by incorporating a shoe sole, typically cushioned, with a cavity into which a slide plate is recessed to enable the user to perform grinding maneuvers. The apparatus provides the capability to perform grinding maneuvers without hampering the user's ability to continue with daily activities or to participate in such traditional exercises as walking, running, and working. In its most basic configuration the present invention comprises a slide plate that is attached within the bottom surface of a shoe sole to present a low friction, downward facing surface to slide along a support rail and the like. As fully described below, the different designs and implementations of the present invention do not interfere with the normal walling or running gait cycle of the user. It must be understood that while each of the figures that accompany the disclosure depicts an article of footwear that is meant to be used on the left foot of a user, every embodiment disclosed herein is equally adaptable to use on the right foot of a user.

Figure 1:
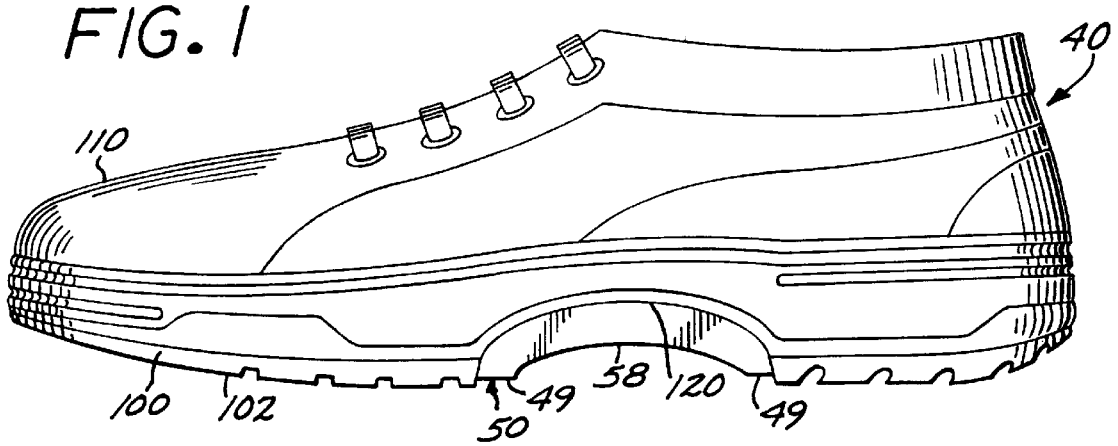
FIG. 1 is a side view of footwear apparatus for the left foot with a slide plate according to the present invention.

Referring to FIG. 1, the preferred embodiment of the present invention is comprised of an athletic shoe 40, that is, a shoe adapted in design and manufacture for activities involving running and jumping, and is commonly understood to include shoes such as running, cross training, aerobics, basketball, tennis, skateboarding and other similar shoes. The shoe 40 shown in the exemplary embodiment is a left shoe and includes, generally, an upper 110 mounted to a sole 100 formed with a cavity 120 extending across the arch region of the bottom surface 102 of such sole. The upper 110 may be formed from leather, canvas, plastic or any other material known in the art to provide the necessary strength and flexibility to enclose the user's foot. To fasten around the user's foot, the upper 110 may be provided with laces, Velcro™ hook and loop fasteners, or any other convenient fastening devices. The upper 110 may be mounted to the upper surface of the sole 100 by any workable method, including sewing the upper to the sole with thread, bonding with glue or epoxy, directly injecting, fusing, welding, molding the two pieces together, or any combination thereof.

Figure 3:
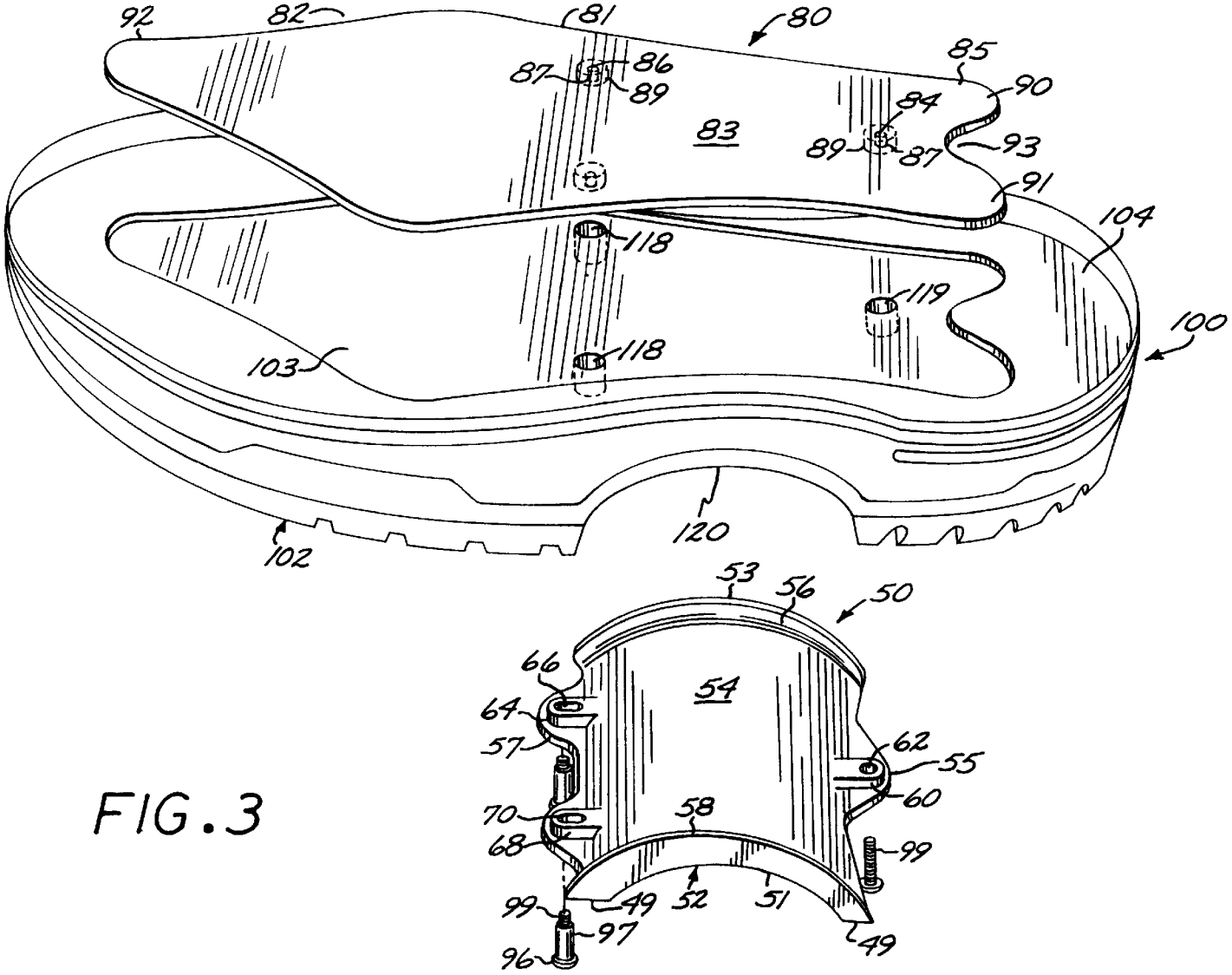
FIG. 3 is an enlarged scale exploded perspective view of the slide plate, sole and anchor plate assembly mounted to the footwear apparatus shown in FIG. 1.

As shown in FIG. 3, an arcuate slide plate 50 formed by a shaped sector of a cylindrical wall is configured with a convex upper surface 54 conforming substantially to the cavity 120 and a concave bottom surface in the form of a downward facing, substantially semi-cylindrical trough 52, and is fastened within such cavity 120. The sole 100 must be of sufficient thickness to accommodate a cavity 120 sized to retain the slide plate 50 at a depth of preferably 9 mm as measured between the high point of the trough 52 of the slide plate and the underlying horizontal supporting surface (herein after "rise"). It has been found that a rise ranging between 6 to 15 mm allows a relatively modest vertical profile for the shoe 40 (FIG. 1) while providing the necessary support to the arch of the foot as well as sufficient curvature to perform grinding maneuvers. A higher rise of approximately 13 mm is ideal, but the extra support provided by such a rise may be sacrificed in favor of a thinner sole 100 and a lower overall profile for the shoe. A sole 100 of about 27 mm to 35 mm in thickness, as measured along the longitudinal axis of the sole, has been found to accommodate a cavity of sufficient depth to allow for a slide plate 50 rise of 9 mm. The bottom surface 102 of the sole 100 that comes into contact with the supporting surface during the user's gait cycle may be formed with any tread pattern as dictated by the athletic functions the user of the shoe 40 (FIG. 1) intends to perform in addition to grinding, such as walking, running, jumping, etc.

Referring again to FIG. 3, the cup 104 of the sole 100 is further formed with two anterior laterally spaced apart through bores 118. The sole 100 is preferably compression molded from rubber heated to its glass transition temperature while applying pressure to conform the rubber into a mold bearing the desired sole configuration. Other materials such as leather, plastic or polyurethane may also be employed, but rubber is preferred for its abrasion resistance and relatively high coefficient of friction, both highly desirable characteristics for the soles of footwear. In addition, rubber is shock absorbent and greatly increases the comfort of the wearer by cushioning the foot from the impact of walking or running. Rubber can be easily cast in a variety of complex shapes and in any desired thickness, and can therefore be manufactured to accommodate practically any slide plate configuration. Furthermore, rubber can also be cast in varying degrees of hardness, and can be manufactured in any color and practically any surface pattern to appeal to the aesthetics and fashion sense of different market segments.

Most other materials typically used to manufacture shoe soles, while offering some or most of the desired characteristics, also have one or two drawbacks that render them less than ideally suited to the present application. Leather, for instance, offers excellent wear resistance and flexibility, but is difficult to form in the required thickness, has a relatively low coefficient of friction, and forming hollow cavities with complex configurations in a leather sole would place great demands on the craftsman and be labor intensive. Similarly, while plastic can be cast in almost any shape and exhibits relatively high wear resistance, compromises in plastic soles involves flexibility and resiliency, and so are typically not as comfortable as rubber soles.

Figure 2:
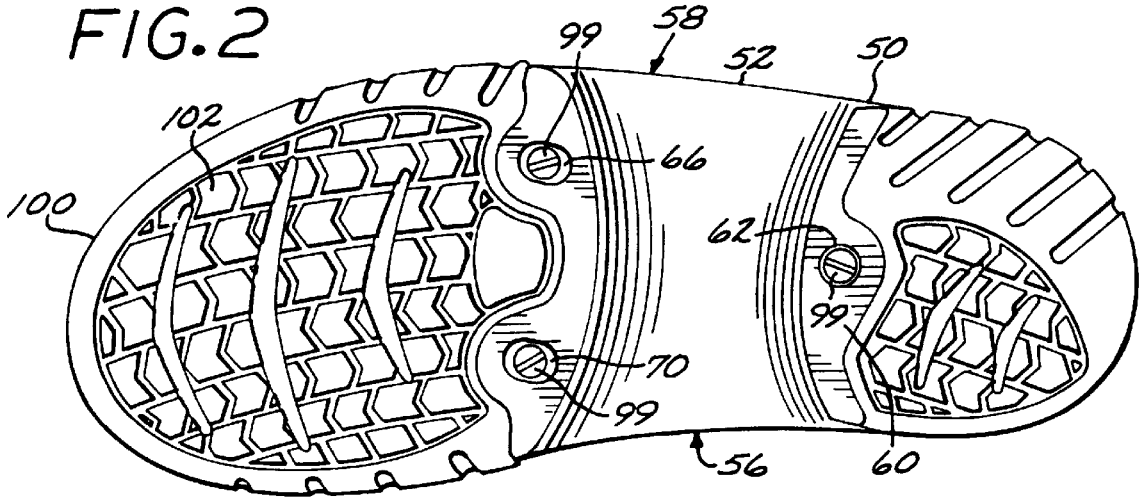
FIG. 2 is a bottom view of the footwear apparatus shown in FIG. 1.

With reference to FIGS. 2 and 3, the slide plate 50 is comprised of, in plan view, a four sided, generally trapezoidal monolithic body configured as a sector of a cylinder having a wall thickness of approximately 8 mm to provide sufficient structure to withstand shock and present sufficient body to endure considerable wear. The lateral side is configured to project in a generally straight line extending in the longitudinal fore-aft direction or in a direction angling forwardly and laterally at an angle up to about 5° to the fore-aft direction. The medial side angles forwardly and medially at an angle of about 15° from the fore-aft longitudinal direction to generally complement the cut of the medial instep of the sole of a conventional shoe. The bottom trough 52 is preferably formed with a smooth surface, generally semi-cylindrically spaced at the height of such trough with a radius of curvature of about 12 cm and flares upwardly at the opposite sides. The cylindrically shaped slide plate terminates at its anterior and posterior ends in downwardly facing edges 49 disposed in a horizontal plane spaced vertically above the horizontal plane including the horizontal bottom tread surface 102 defined by the bottom of the sole 100. The slide plate 50 is constructed of a material selected to afford the desired low coefficient of friction sliding characteristic, as well as high abrasion resistance to withstand repeated sliding across abrasive supporting surfaces such as concrete. The slide plate must sustain sliding over an extended length of a vertical supporting surface and over the entire length of a downwardly sloping surface such as a typical staircase handrail and the coefficient of friction should therefore be sufficiently low to allow the force created by gravity to cooperate with the forward momentum of the guide to overcome the frictional resistance of a rail, concrete curb, and the like. In addition, the material selected must offer substantial rigidity when injection molded in the dimensions specified in the disclosure to allow the user to maintain control while engaged in grinding maneuvers, because any undue flexing while sliding would adversely impact the user's ability to receive feedback from the reaction forces applied to the underside slide plate 50 and control its direction. A material known to exhibit these desirable characteristics is Supertuf 801 Nylon available from Dupont. Other materials that may be found to be acceptable include other forms of nylon, such as Nylon 6, plastics such as PTEX, hard rubbers, glass, ceramics, metals, polyethylene and composites. While a substantially rigid slide plate is preferred, those skilled in the art will realize that further embodiments of this apparatus may incorporate more flexible slide plates in order to appropriately tailor performance characteristics to meet the requirements of various grinding surfaces or grinding maneuvers.

Referring to FIG. 3, the configuration of the upper surface 54 of the slide plate 50 is an approximate mirror image of the bottom surface in a slightly larger radius of curvature and is upward facing, convex, and substantially semi-cylindrical. The upper surface 54, however, is not critical to the practice of the invention and may be configured in any shape as may be dictated by practical or aesthetic considerations to nest in the corresponding cavity in the bottom of the shoe sole. One such practical consideration of considerable importance is the fact that the upper surface of the slide plate is received complementarily in a cavity formed in the shoe sole. It is advantageous if the configuration of this cavity does not require complex manufacturing steps. It is also desirable that the cavity in the sole does not adversely impact the characteristics of the sole, such as support, stability, safety, comfort, and strength. Thus, for example, an overly convex slide plate upper surface may necessitate an especially deep cavity in the sole that will dictate a very thick sole or else a very thin arch area that would offer only limited support and become prone to failure after a short service life. Similarly, a multi-faceted and angular slide plate upper surface may require additional manufacturing or finishing steps before the sole can be used in the final assembly. It has been found that the slide plate upper surface design of the present embodiment does not necessitate the use of an overly thick sole in the shoe, is relatively simple to manufacture, and cooperates with the arch of the sole to provide a supportive and comfortable platform for the user's foot.

As shown in FIG. 3, the top surface 54 of slide plate 50 is somewhat saddle shaped to curve upwardly in hyperbolic fashion at the opposite sides and is configured with respective medial and lateral raised arcuate, high performance rails 56 and 58 which cooperate to retain the foot centered over such plate and form respective outwardly facing curved slide runners 51 and 53 for gliding contact with the support surface when the shoe is laid over on its side. Such rails raise upwardly about 5 mm above the major top surface of such plate. The rearward edge of the slide plate is formed with a mounting flange 55 configured with a centrally disposed, rearwardly projecting posterior anchor tab 60 configured with a through bore 62 aligned with the anchor bore 62 in the sole cup 104 and constructed on its bottom side with a downwardly opening countersunk recess. The slide plate is further formed at its anterior end with a forwardly projecting mounting flange 57 configured with a pair of laterally disposed anterior float tabs 64 and 68 formed with through, longitudinal slide slots 66 and 70 configured to be disposed in alignment beneath the anterior bores 118 in such sole 100. The slide slots 66 and 70 are configured on their bottom sides with longitudinally extending countersunk recesses. The posterior and anterior flanges 55 and 57 are about 3 mm thick and the mounting tabs 60, 64, and 68 are approximately 6 mm thick.

Still referring to FIG. 3, one embodiment of the present invention also includes an anchor plate, generally designated 80 overlying the mid-sole and which may be in the form of a generally horizontal hard plastic foot frame 82 and having a swallow-tail shaped, rearwardly projecting heel portion 85. The foot frame 82 is configured in plan view with a wide, relatively thick forward control section 81 disposed forwardly under the arch of the foot and bulging medially outwardly and laterally outwardly forward of the two anterior bosses 89. The edges thereof then curve forwardly and laterally inwardly to a form a thin rounded forward edge 92. The medial and lateral edges of the foot frame project rearwardly from the forward control section 81 to form an arch section 83 and a heel section 85 configured with outwardly flared rearwardly projecting tail sections 90 and 91 configured somewhat in the form of a swallow's tail and arranged to form therebetween a generally V-shaped rearwardly opening notch 93 disposed to the sides of the heel bone.

It will be appreciated by those skilled in the art that the bulk of the user's foot control is exhibited generally over the central arch section 83. To facilitate this control, the major rigidity in the foot frame is formed in the mid-foot section 83 which prevents excessive convex flexing of the foot and provides support to the user in the act of grinding. In addition, three bosses 89 triangulated about the mid-foot section of the foot frame 83 cooperate to react torsional loading. The foot frame 82 projects forwardly approximately 3.5 cm from the control section 81 having a major width of 7.5 cm to form a rounded forward end 92 configured to control the flexibility of the forward portion of the shoe. Such plate tapers laterally rearwardly from such control section 81 to a width of about 5.5 cm for the heel section 85. The V-opening notch 93 is cut at a longitudinal depth of about 1.8 cm into the body of the foot frame itself and acts to prevent contact between the heel bone and the foot frame. The control section 81 is formed with a thickness of 2 mm and the thickness of the foot frame tapers gradually forwardly from the two anterior bosses 89 to a minimum thickness of about 1 mm. The control section 81 is formed with two laterally spaced bolt sockets 86 and 88 aligned over the bores 66 and 70 formed in the float tabs 64 and 68 and the heel section 85 is formed with a central bolt socket 84 disposed over the anchor tab 60. The foot frame is formed with downwardly depending cylindrical bosses 89 configured with upwardly opening sockets which receive respective insert molded threaded tubular brass or stainless steel inserts 87 aligned under the respective bores 84, 86, and 88.

Referring once again to FIG. 3, the foot frame 82 is oriented such that the bolt sockets 84, 86 and 88 are disposed directly over and coaxial with the corresponding front through bores 118 and aft through bore 119 formed in the sole 100, and the corresponding through bore 62 and slide slots 66 and 70 formed in the slide plate anterior and posterior mounting tabs 64, 68 and 60.

Referring to FIGS. 1, 3, 6 and 7, the anchor plate sockets 84, 86 and 88 together with the slide plate through bore 62 and slide slots 66 and 70 cooperate with the through bores 118 and 119 formed in the sole 100 of the shoe 40 to receive button head shoulder screws 99 to secure the slide plate 50, shoe 40, and foot frame 82 together in a snug, rattle free configuration by threading the fasteners into the threaded brass inserts 87 secured within the foot frame 82. The screws are preferably Nylock® self locking screws of 4 or 5 mm shaft diameter, approximately 12 mm head diameter, and varying length as dictated by the overall height of the slide plate tabs 60, 64 and 68, shoe sole 100, and bores 89. The shafts of the screws 99 are received through the forwardly projecting tab slots 66 and 70 and are sandwiched between the bottom end of the respective bosses 89 and annular shoulder of respective buttons the heads 96 of the fasteners.

The shoulder screws 99 are sufficiently long to act as spacers to, when the screws are fully tightened, stand the shoulders of the respective button heads 96 about 1 mm off from the overlying bottom surface in the respective countersinks in the respective tabs 64 and 68 to provide some play for such tabs and allow relatively free floating thereof. Screws of various lengths and or materials such as elastomers may be used to accommodate different slide plate materials and thicknesses, giving the user the ability to adjust performance characteristics of the slide plate to match the requirements of different grinding surfaces.

The slide plate 50 is next selected and inserted within the cavity 120 of the shoe sole 100, where it is secured by threading the screws 99 through the slide slots 66 and 70 and the through bore 62, on through the through bores 118 and 119 formed in the shoe sole, and into the anchor plate threaded inserts 87 made of brass, stainless steel or other materials. The screws are conveniently provided with engagement slots or sockets formed in the top surface of the heads 96 for engagement by a screwdriver or other tool for quick and easy turning of the screws. Alternatively, or in addition, high strength adhesives such as epoxy may be employed to fasten the slide plate to the surface of the sole cavity in a permanent configuration that sacrifices slide plate interchangeability for a stronger, more secure bond.

Slide plates 50 can be manufactured in a variety of styles to fit a variety of uses, and the rapid replacement feature detailed above enables quick swapping of slide plates to accommodate varying conditions and surfaces. The slide plates can thus be manufactured from different materials that will provide varying degrees of abrasion resistance and sliding ability to accommodate such different surfaces as, for example, concrete curbs and steel handrails. In this manner a user may choose, for example, a certain slide plate for grinding on a steel handrail and a different slide plate offering improved abrasion resistance when grinding on a concrete surface, and may also choose to install one type of slide plate on the right shoe and a different type of slide plate on the left shoe.

Slide plates 50 may also be formed with different downward facing configurations, and thus a slide plate adapted for steel rails may feature a narrower sliding surface 52 with higher side walls 56 and 58, whereas a slide plate for concrete curbs may feature a wider, flatter sliding surface flanked by low side walls. In addition, slide plates may be manufactured in different colors that appeal to the fashion sense of the user, and individual slide plates may be formed with strata of different colors to indicate the level of wear upon the plate and thus aid the user in determining when the slide plate should be replaced.

In operation, when a user desires to participate in a grinding exercise, he or she may put on the shoe and can walk or run in the normal fashion. The slide plate is sufficiently recessed upwardly from the bottom surface of the sole 100 to reduce contact with the supporting surface.

Figure 4:
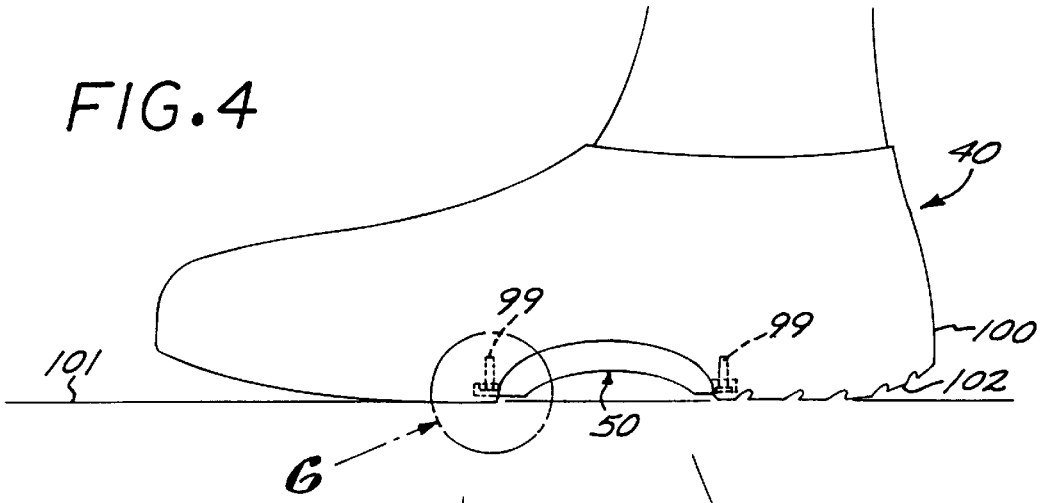
FIG. 4 is a side view of the footwear apparatus shown in FIG. 1 in operation during a walking gait with the entire sole contacting the ground.
Figure 5:
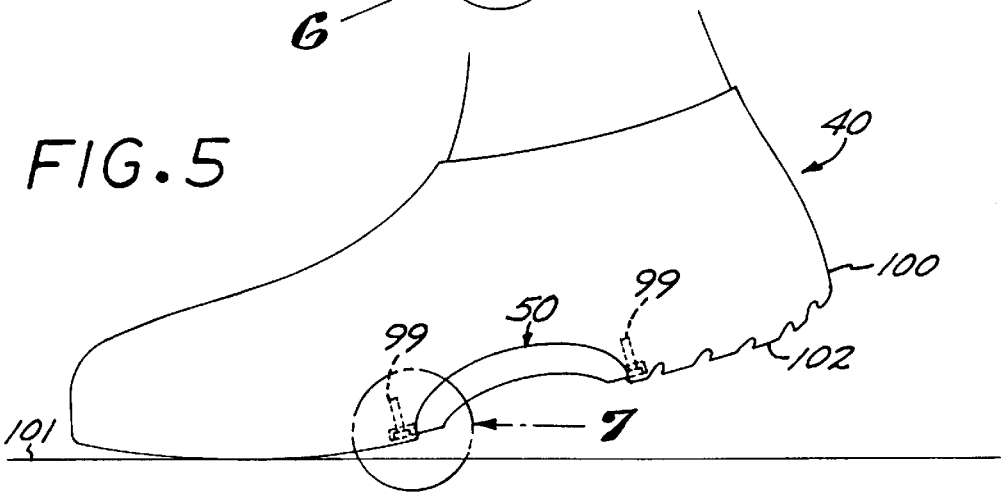
FIG. 5 is a side view of the footwear apparatus shown in FIG. 1 in operation during a walking gait with the forefoot portion of the sole contacting the ground.
Figure 6:
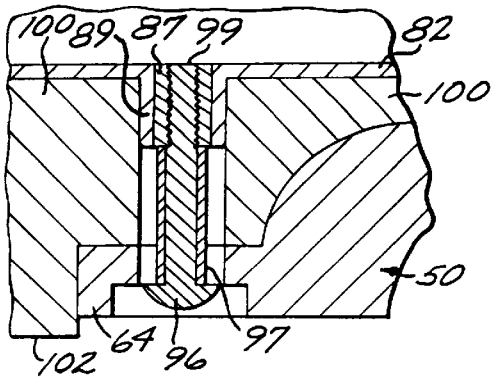
FIG. 6 is an enlarged section view of the front edge of the slide plate of the present invention shown in FIG. 4.
Figure 7:
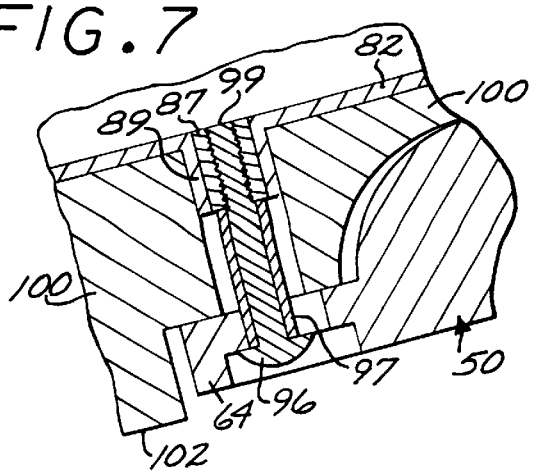
FIG. 7 is an enlarged section view of the front edge of the slide plate of the present invention shown in FIG. 5.

Referring now to FIGS. 4 and 5, as the user walks or runs along a sidewalk 101 or playground, the sole 100 of his or her shoe and the foot frame 82 will flex with each step taken to accommodate the bending of his or her feet, and the bottom surface 102 of each sole will therefore alternately expand and contract to accommodate this movement. Because the normal gait of an upright human involves first contacting the heel of the shoe and then rolling forwardly onto the ball of the foot and then lifting the heel up, most of the accompanying flex in the sole is localized in the forward and metatarsal area of the foot. As shown in FIGS. 6 and 7, the present invention is designed to accommodate this flexing by anchoring the slide plate 50 to the heel portion of the sole 100 through the rearwardly projecting mounting tab 60 and allowing the front of the slide plate to float relative to the front screws 99 by sliding of the float tabs rearwardly on such screws through the elongated slide slots 66 and 70 as the sole flexes when the heel is drawn upwardly and rearwardly to flex in somewhat of an arc as the heel is raised relative to the ball of the foot. The shoulders of the screws prevent the screw heads 96 from coming in contact with the bottom of the counter bored recesses in the anterior mounting tabs 64 and 68, and thereby serve to minimize wear and tear on the slide plate 50. The screw heads 96 are counter bored within the slide plate 50 and do not come into abrasive contact with the grinding surface, and therefore can be reused when the slide plate is replaced. The slide plate of the present invention thus allows the sole of the shoe to function along the supporting surface in the manner typical to most footwear and does not force the user to change her normal gait, unlike other specialized articles of footwear such as ski boots whose narrowly focused design comes at the expense of the basic functions of walking and running. The present invention therefore provides a single shoe apparatus that is equally adapted to the distinct functions of walking, running and sliding, and unites the two activities seamlessly with no loss of functionality or comfort.

It will be appreciated by those skilled in the art that the gradually increasing flexibility of the foot frame 82 forwardly of the control section 81 toward the toe 92 will distribute flexure of the sole 100 forwardly of the slide plate 50 for comfortable walking or running, and will serve to prevent the tendency of such sole to flex primarily just along a transverse line immediately forward of the front edge of such plate 50 to thereby avoid the tendency of such sole to over-flex, which over time, would form a weakening crease at that location and would allow debris to enter. Likewise, the foot frame will tend to distribute flexure of the sole rearwardly to thereby accommodate normal walking and running steps while avoiding the tendency to form a weakening crease at the rear of the slide plate 50. Additionally, the V-shaped opening 93 beneath the heel bone positioned above a shock absorbing plug 452 (FIG. 26) will provide for cushioning of the heel bone directly against the sole 100 to thereby minimize bruising and injury.

It will be appreciated that in a highly athletic activity involving, for instance, an aggressive grinding maneuver wherein the athlete might jump with some force onto a hand rail, pipe or similar elongated surface, the landing force of the athlete may be several magnitudes greater than the weight of the athlete, i.e. exceeding eight times the weight of the athlete. As an athlete jumps onto, for instance, a pipe, the pipe will typically be received in the downwardly opening trough 52 of the slide plate 50 and more often than not the athlete will endeavor to land in a position causing the initial impact to be received on the medial rearward end of such plate in the area of the posterior mounting flange 55. The slide plate 50 of the present invention has sufficient structural integrity to withstand such impacts and also accommodate the wear resulting from such plate sliding laterally over the surface of such underlying pipe. It is also of benefit that the force of the athlete's impact will exert forces downwardly through the saddle shaped plate 50 in a manner which will cause the upturned, upwardly curved lateral edges thereof to nest the shoe sole and foot even more firmly in a laterally centered position within the saddle shape of the plate.

As the athlete maneuvers in a gliding action along such pipe, he or she can maneuver the foot about to maintain control or execute further acrobatic maneuvers. In this regard, it will be appreciated by those skilled in the art that the foot frame 82 provides for torsional flexure while maintaining a secure coupling to the slide plate 50 to thereby impart control from the user's foot to the shoe sole and into the slide plate 50 for positive control thereof The foot frame also serves to distribute vertical forces laterally and longitudinally.

When the wearer elects to undertake a maneuver requiring a crouch position, he or she may bend the knees into a deep bend and lay one knee over medially which will involve inclining the slide plate 50 to a laterally inclined position, up to an incline approaching 75° or 80° from the horizontal. In this maneuver, the arcuate medial rail 56 will carry the entire weight placed on that foot of the user and the outwardly facing runner 53 will slide along the underlying pipe, again keeping the plate centered over the top of such pipe.

Figure 8:
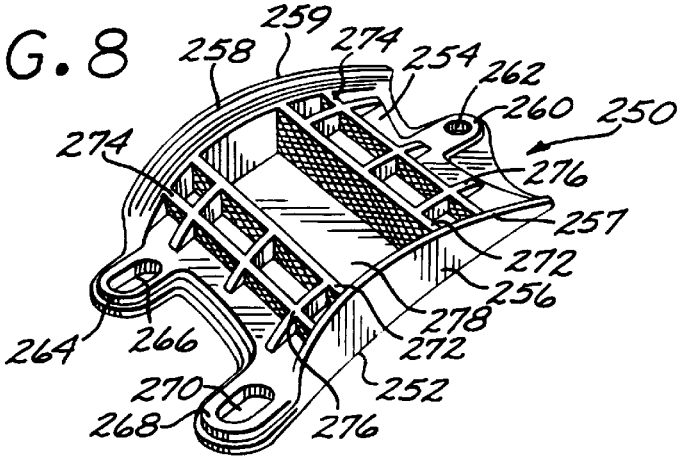
FIG. 8 is a perspective view of a second embodiment of a slide plate according to the present invention.

In a further embodiment of the present invention (FIG. 8) a slide plate, generally referred to as 250, is formed by a four sided, generally trapezoidal monolithic body 254 configured with a downward facing, concave, substantially semi-cylindrical trough 252, and upturned, laterally disposed arcuate side walls 256 and 258 terminating at their respective upper extremities in arcuate retainer rails 257 and 259, respectively. The anterior extremity of such plate is formed with a contoured mounting flange configured with a pair of laterally spaced apart anterior flat tabs 264 and 268, including respective elongated slots 266 and 270. The posterior extremity of such plate is formed with a contoured mounting flange configured with a central, rearwardly projecting anchor tab 260 including through bore 262. The body of such plate is formed with a rectangular rib network defining respective laterally projecting inner ribs 272 and outer ribs 274 terminating at their respective upper edges flush with the upper edges of the arcuate rails 256 and 258. Longitudinal ribs 276 extend from each lateral inner rib 272 through each respective lateral outer rib 274. Formed between the inner ribs 272 and side rails 256 and 258 is a rectangular open top storage compartment 278 where users might store money or the like.

Figure 9:
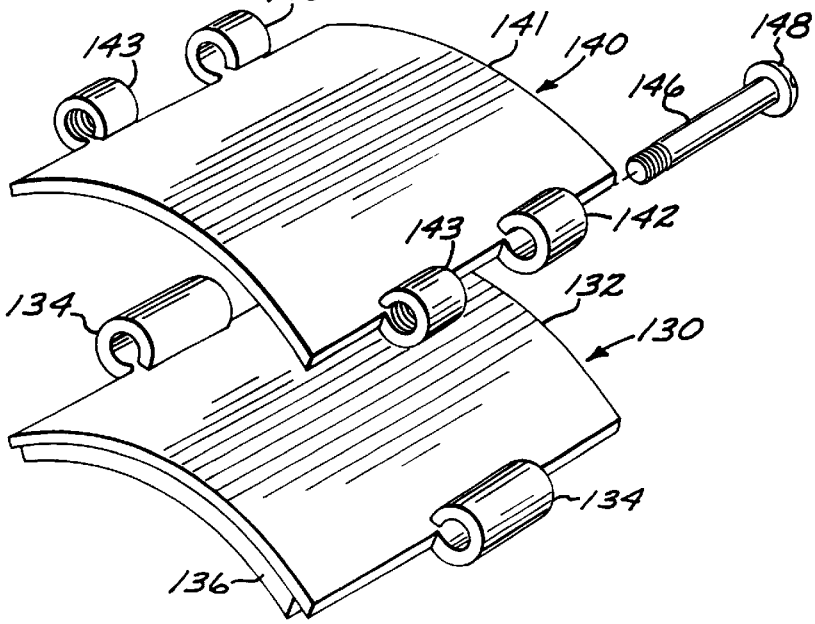
FIG. 9 is an exploded perspective view of a third embodiment of a slide plate and base plate assembly according to the present invention.
Figure 10:
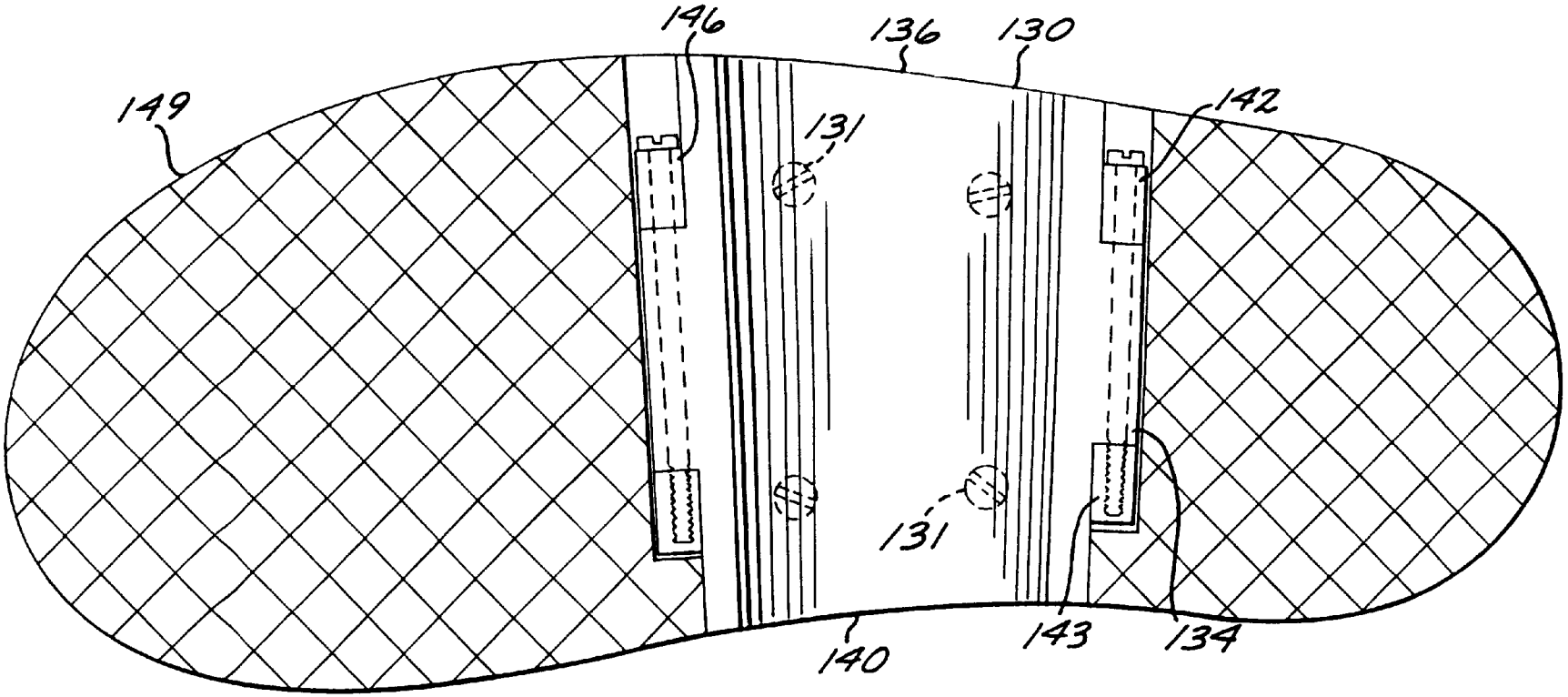
FIG. 10 is a bottom view of footwear apparatus with a slide plate as shown in FIG. 9, shown in double scale for clarity.

Referring to FIGS. 9 and 10, in an alternative embodiment of the present invention, the slide plate apparatus, generally designated 130, is constructed to be fastened to a base plate, generally designated 140, mounted within a complementarily shaped cavity formed in the sole of an article of footwear. The base plate 140 is comprised of a generally rectangular plate 141 formed in a concave, semi-cylindrical configuration with pairs of laterally aligned, forwardly and rearwardly disposed, cylindrical mounting barrels 142 and 143 for receipt of respective coupling pins 146. The barrels 143 are threaded for securing thereto of the respective threaded tips of pins 146. Such pins are formed with respective retainer heads 148.

The base plate 140 may be formed from any material that offers the preferred characteristics of stiffness and light weight, including plastics, metals, ceramics, and composites. Depending on the material of construction, the cylindrical barrels 142 may be formed by hot or cold rolling planar extensions of the base plate into the requisite cylindrical shape, or may be formed separately and then secured to the edges of the base plate 140. The base plate 140 is ideally of the minimum thickness required by the chosen material of construction to maintain stiffness.

With continued reference to FIG. 9, the slide plate 130 is comprised of a generally rectangular in plan view, concave, semi-cylindrical plate 132 configured with an upper surface of substantially complementary shape to the lower surface of the base plate 140. Two opposing edges of the slide plate 130 corresponding to the mounting edges of the base plate 140 are each equipped with a centrally disposed, upwardly turned, laterally projecting mounting tabs defined by a cylindrical barrel 134 of length equal to the distance between adjacent base plate cylindrical barrels 142 and 143 for sliding receipt therebetween. The slide plate barrels 134 extend parallel to the respective front and rear edges of the slide plate barrels.

The downward facing surface of the slide plate 130 is equipped with a low friction, high abrasive resistance layer 136 that presents a downward facing, concave, semi-cylindrical lower surface for slidably engaging a supporting surface. The low friction layer may be attached to the slide plate by any means of sufficient mechanical strength to withstand the shear forces generated during grinding maneuvers, such as chemical bonding. The lower surface of the low friction layer may be formed with a smooth, continuous configuration, or alternatively may be configured with ribs or other protuberances that reduce total sliding area and thus total frictional resistance. Alternatively, the entire slide plate 130 may be formed from a low friction material exhibiting sufficient stiffness and mechanical strength to be directly attached to the base plate 140.

Referring to FIG. 10, in operation the base plate 140 is secured within the complementary shaped cavity formed in the sole of the shoe. The base plate 140 may be secured directly to the sole 149 through any practicable means including chemical bonding or mechanical fasteners, and may used in conjunction with an anchor plate as described previously and illustrated in FIG. 3. The embodiment illustrated in FIG. 10 employs four screws 131 to mount the base plate 140 to the sole 149. The base plate 140 is preferably recessed within the sole cavity at a depth sufficient to reduce contact by the slide plate 130 with the supporting surface when the slide plate is attached to the base plate. This is an important consideration to prevent interference with the user's normal gait cycle, as explained previously in the disclosure.

The user may next select a slide plate 130 having the desired low friction layer 136, mounts the slide plate adjacent to the base plate 140 with the slide plate mounting barrels 134 disposed between the corresponding pair of base plate mounting barrels 142 and 143, and locks the slide plate to the base plate with the threaded fasteners 146. As described in the disclosure, low friction layers may be formed in many different materials, colors, sizes, and bottom configurations, and the design of the present embodiment allows the user to quickly and easily change slide plates at any time she may choose to do so. As specified above, the fasteners are preferably self locking screws, thereby reducing the likelihood that the vibrations and shocks experienced by the shoes during use will loosen and eventually eject the screws from the mounting tabs 134 and 142.

As disclosed previously, with the slide plate 130 securely mounted to the shoe a wearer may walk or run along a sidewalk, street or path at his or her chosen gait, and upon encountering an inviting curb, rail or the like may readily proceed with any one of a number of grinding activities. Because the design of the present embodiment places all grinding elements outside of the shoe interior, additional cushioning material may be placed over the insole to increase the user's comfort and safety during grinding maneuvers. In addition, because the slide plates are relatively compact the user may conveniently carry one or more slide plates in a bag or even in a coat or pant pocket and interchange them as the grinding conditions encountered may warrant, thereby increasing the range of her grinding options and opportunities.

Figure 11:
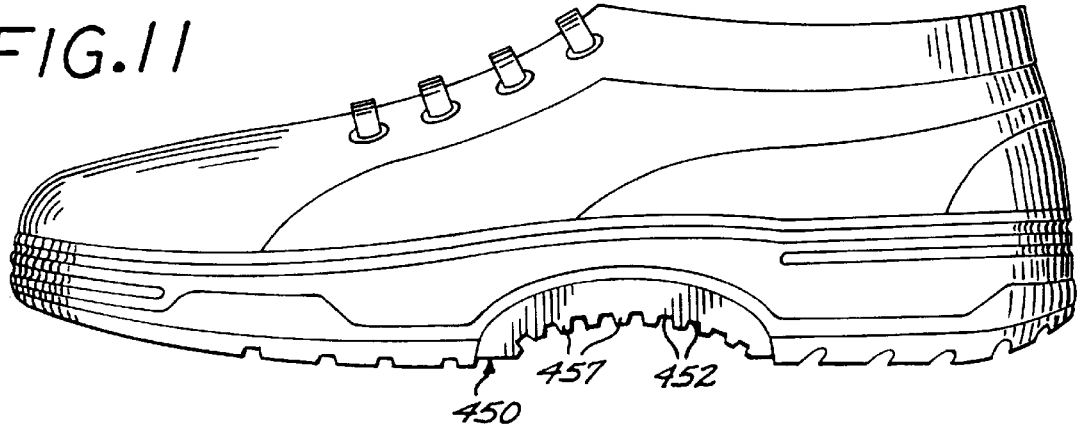
FIG. 11 is a side view of grinding footwear apparatus incorporating a fourth embodiment of the present invention.
Figure 12:
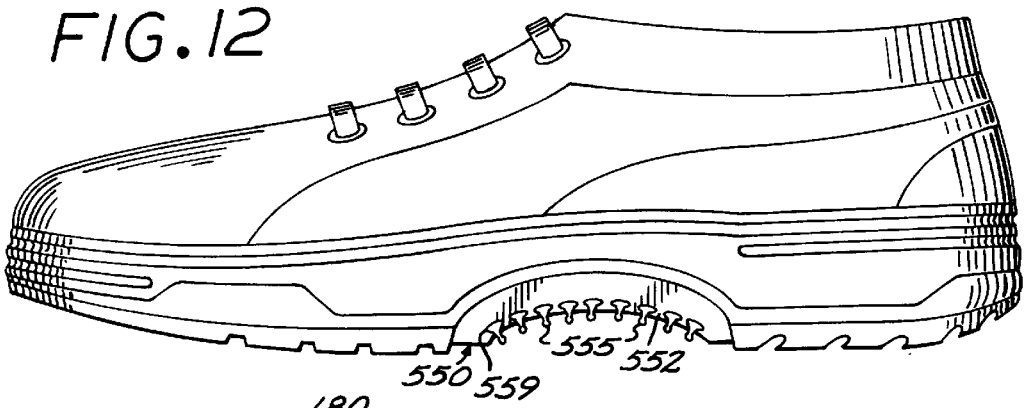
FIG. 12 is a side view of grinding footwear apparatus incorporating a fifth embodiment of the present invention.

In an alternative embodiment as depicted in FIG. 11, the slide plate of the present invention may be formed with a downward facing trough 452 configured with ribs 457 that offer reduced surface area to contact the supporting surface and thus act to minimize the level of frictional resistance encountered. Alternatively, as depicted in FIG. 12, the downward facing trough 552 may be formed with grooves 559 that receive and secure complementarily shaped, elongated sliding elements 555 which protrude from the surface of the slide plate 550 to form ribs that provide reduced sliding surface area and lower overall frictional resistance. The grooves 559 are formed with a substantially upper case omega-shaped (Ω) cross section comprising a narrow opening flanked by two ridges that cooperate to trap corresponding necks formed in the sliding elements 555 and prevent the sliding elements from being pulled out. Such elongated sliding elements 555 are easily replaced when worn down simply by being pushed out of their grooves 559, and thus preclude the necessity for a removable slide plate. In an alternative configuration, elongated sliding elements (not shown) may be received in complementary grooves formed directly in the sole of the shoe to cooperate in collectively defining a slide plate. To maintain the elongated sliding elements of this alternative design in fixed position while sliding along a supporting surface, and thereby prevent the sliding surface from forcing the sliding elements apart and contacting the underlying sole, the sole material in which the receiving grooves are formed must be of sufficient rigidity to withstand the shear forces imposed by the sliding motion. In either design, the ribs should be spaced about 3 mm apart. An additional advantage of using grooved slide plates is that footwear equipped with such sliding elements stops functioning as a grinding apparatus entirely when the sliding elements have been worn too far because in such circumstance the sliding surface comes into direct contact with the high friction sole of the shoe and thus precludes any possibility of sliding altogether. Footwear equipped with such elongated sliding elements therefore has a built-in warning mechanism for alerting the user to the need to replace the sliding elements.

Figure 13:
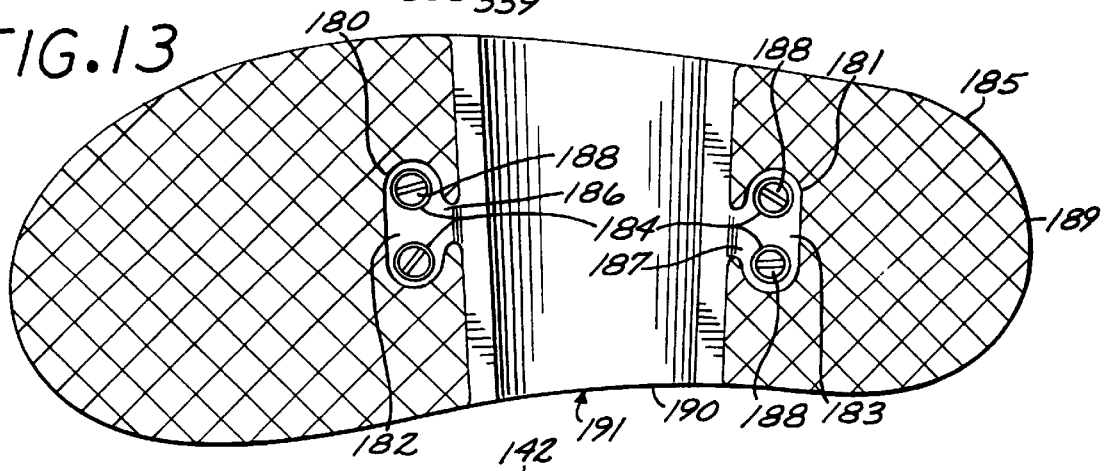
FIG. 13 is a bottom view of grinding footwear apparatus incorporating a sixth embodiment of the present invention.

Another embodiment of footwear apparatus incorporating the present invention is depicted in FIG. 13, where the sole 189 of a shoe is formed with a cavity 190 that extends laterally across the arch region of the sole and includes oval shaped centrally disposed anterior and posterior central tab pockets 180 and 181 configured with respective necked down stem-receiving channels 186 and 187. The slide plate, generally designated 191, of the present embodiment is formed with a body having an upper convex surface substantially conforming to the shape of the sole cavity 190, and is farther configured with centrally disposed longitudinally projecting mounting tabs 182 and 183 carried from the front and the rear edge of the slide plate by respective stems 186 and 187. Such tabs include countersunk fastener bores 184. The slide plate 191 is mounted within the cavity 190, and the mounting tabs 182 and 183 and corresponding stems 186 and 187 are received in the complementarily shaped forward and aft tab pockets 180 and 181 and corresponding channels 186 and 187. Received in the bores 184 are fasteners 188 to secure the slide plate 191 within the cavity 190 by connecting to the sole 189 or to an overlying anchor plate as described previously.

The mounting tabs 182 and 183 of the slide plate 191 are of greater cross-section than the stems 186 and 187 and therefore when the mounting tabs are disposed within the corresponding cavity in the sole 189, the slide plate 191 is immobilized in place in a stable configuration that will not be disturbed by vibrations and shocks. Despite the added stability, the slide plate 130 of the present embodiment retains the ease of removal and replacement that characterizes the slide plate designs described elsewhere in the disclosure. The slide plate 191 may incorporate more than one mounting tab 182 or 183 attached to each edge, or alternatively may have one or more mounting tabs attached to only one edge. The stems 186 and 187 that attach the mounting tabs 182 and 183 to the slide plate 150 may be formed in a flexible configuration that expands and contracts to conform to the repeated elongation of the sole's bottom surface 185 caused by a walking or running gait.

Figure 14:
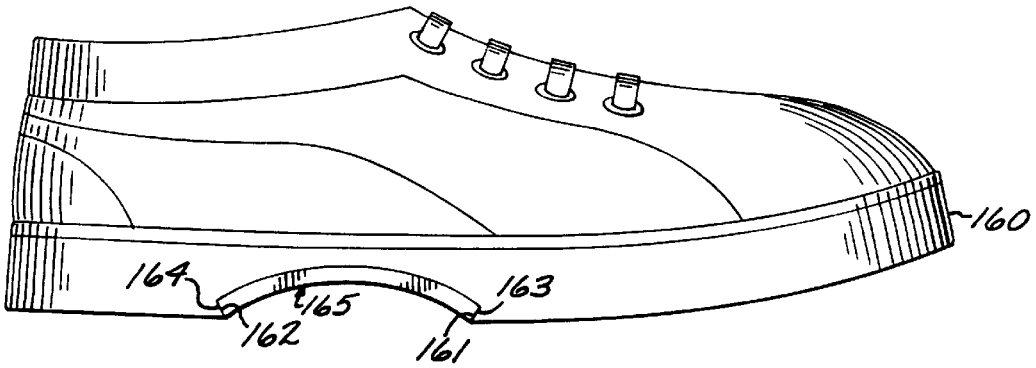
FIG. 14 is a side view of grinding footwear apparatus incorporating a seventh embodiment of the present invention.
Figure 15:
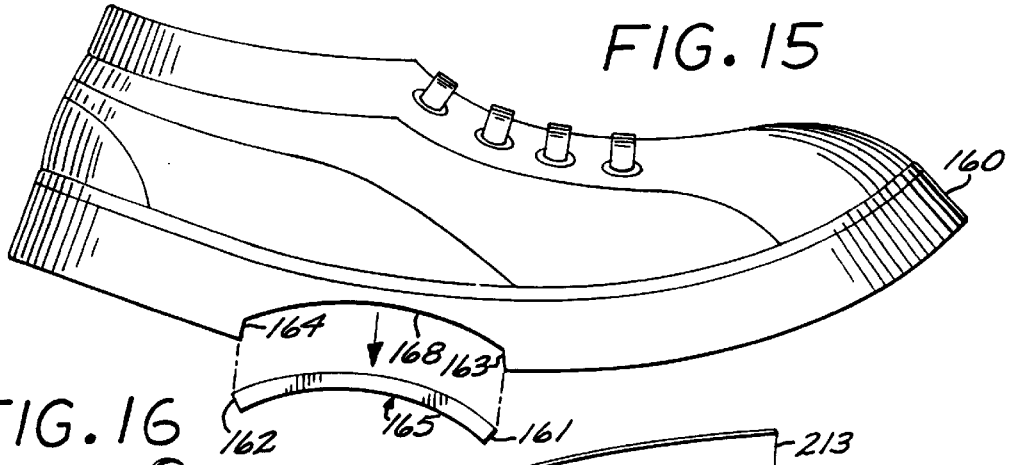
FIG. 15 is a partially exploded side view of the grinding footwear apparatus shown in FIG. 14.

Referring now to FIGS. 14 and 15, an alternative embodiment of the present invention employs a substantially rectangular in plan view, concave slide plate 165 received within a complementarily shaped cavity 168 formed in the bottom of a shoe sole 160. Such cavity is arcuately concave, projects laterally under the constrictable sole of the shoe, and terminates at its front and rear extremities with respective compressible vertical end walls 163 and 164. The front and rear edges 161 and 162 of the slide plate 165 are cut at a chamfer to, respectively, slope upwardly and forwardly and upwardly and rearwardly to be complementary received in the cavity 168 so that, in its normal unflexed position, the walls 163 and 164 will grip against the ends 161 and 162, respectively, of the plate to securely hold it in position. The slide plate is thus retained within the cavity by the friction fit between the respective front and rear edges of the slide plate and the cavity. The cavity 168 is sufficiently high in its sole 160 to ensure that the plate is recessed therein to and the relative longitudinal between such plate and cavity is such that the plate will be held grippingly therein to assure that in the normal flex applied to such shoe causing the toe or heel to bend upwardly, the length of the cavity will not be stretched lengthwise sufficiently to align the walls 163 and 164 to release the respective edges 161 and 162. To remove the slide plate, the user may simply flex the sole in an extreme convex configuration ending the toe and heel upwardly until the edges of the cavity defined by the walls 163 and 164 disengage the ends 161 and 162 of the plate.

This embodiment of a shoe for grinding provides a single element to enable the user to slide along a supporting surface, and employs no mechanical or adhesive fasteners. The resulting shoe is thus lightweight and comfortable, and the user does not need to carry tools of any kind to be able to exchange slide plates at any time she so desires. The uncomplicated nature of this embodiment also carries over into manufacturing advantages because the simple design of the slide plate and the sole lend themselves to easy implementation through a variety of manufacturing processes, including extrusion molding, stamping, and machining.

Although the preceding embodiments have been described in terms of sliding surfaces or elements formed or adapted to shoes, it will be appreciated by those skilled in the art that the apparatus of the present invention is equally adaptable to any and all types of footwear. Sliding surfaces can thus be formed in, and sliding elements adapted to, sandals, boots, shoes, slippers, socks, skates, and any other device or article of wear that is meant to be attached to the human foot. For purposes of illustration, as depicted in FIG. 16, an embodiment of the present invention may also take the form of a device incorporating low friction sliding surfaces and adapted for attachment over an article of footwear or a user's otherwise unshod foot.

Figure 16:
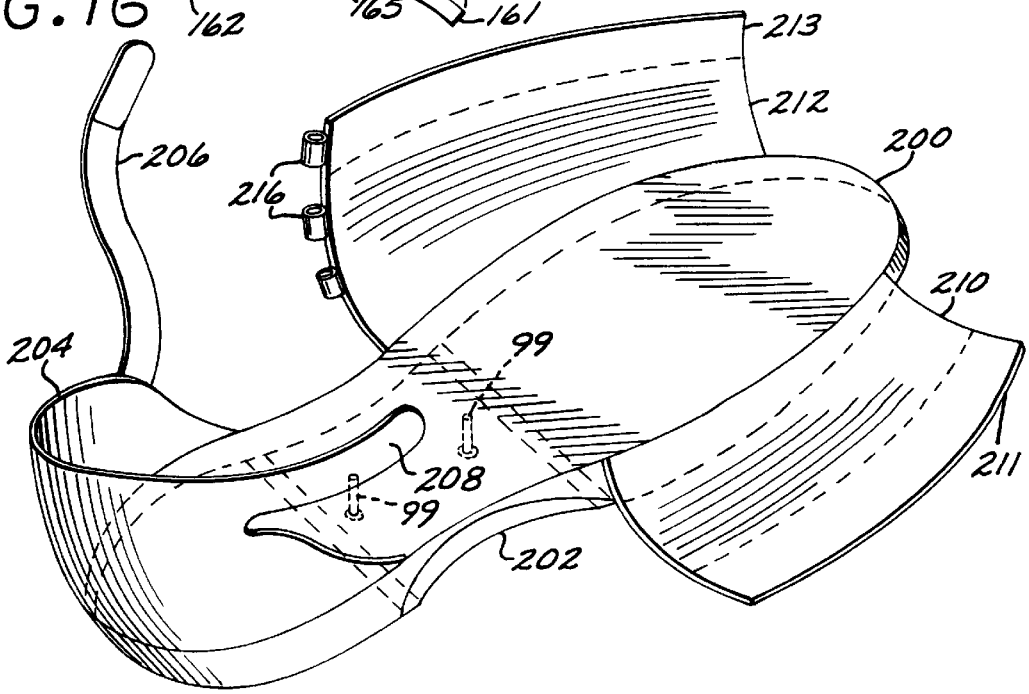
FIG. 16 is a perspective view of grinding footwear apparatus incorporating an eighth embodiment of the present invention.

The grinding sandal shown in FIG. 16 includes a cushioning sole 200 formed with a medial contoured downwardly opening recess removably receiving a low friction sliding plate 202. The sliding plate may be formed in any configuration, including those configurations disclosed previously in the specification, and may be secured to the sole in any manner previously disclosed, or by inserting threaded fasteners 99 as shown. The sole 200 may be formed from an elastic material that will conform to the article of footwear it is encasing and thus accommodate a walking or running gait, or alternatively may be formed from a stiff material that will offer enhanced support during grinding maneuvers.

The sandal includes two laterally disposed instep flaps 210 and 212 extending upward from the upper left and right edges of the sole into overlying relationship of the free marginal edges. The free margins are equipped with fasteners 211 and 213 such as complementary hook and loop fasteners, laces, or zippers that cooperate to securely fasten the two flaps together. The flaps may leave the toe region open or may extend all the way around the front of the sole, and may be constructed from solid sheets of material or may have perforations of any desired shape and size formed therein for improved air circulation and aesthetic appeal. The materials used in constructing the flaps must offer sufficient tensile strength to withstand the rigors imposed by grinding maneuvers, and may include plastic, cloth, leather, and rubber. A semi-cylindrical heel cup 204 rises upwardly from the periphery of the heel, and has connected to the opposite sides thereof two thin straps 206 and 208 with mounting fasteners disposed on their free extremities, such as complementary hook and loop fasteners. Either one of the front flaps 210 or 212 is equipped with open ended, cylindrical lengths of tubing 216 attached to and axially parallel with the rear edge of the flap, and sized to receive either one of the thin straps.

In operation, the present embodiment is positioned with its sole 200 disposed beneath the sole of the article of footwear being worn by the user, or beneath the user's unshod foot and the two flaps 210 and 212 are then fastened together snugly over the user's forefoot region. The thin straps 206 or 208 are next wrapped around the user's foot adjacent to the ankle region, one strap is threaded through the lengths of tubing 216 bonded to the rear edge of either flap, and the two straps are then fastened together securely around the user's foot In this manner the apparatus of the present embodiment is securely fastened around the user's article of footwear or unshod foot in the forefoot region as well as the heel region, and the two regions are held in tension relative to one another by the thin straps pulling back on the flap through the lengths of tubing, thereby enhancing the level of support and stability experienced by the user while engaging in a grinding maneuver. It will thus be appreciated that the present embodiment as described enables persons to engage in grinding activities even when they cannot wear footwear equipped with sliding surfaces, such as due to the work place code of dress or safety requirements, by providing a conveniently sized shoe apparatus that can be easily stored and carried around in a small space and can be quickly deployed and ready for use with a minimum of effort and time expended.

Figure 17:
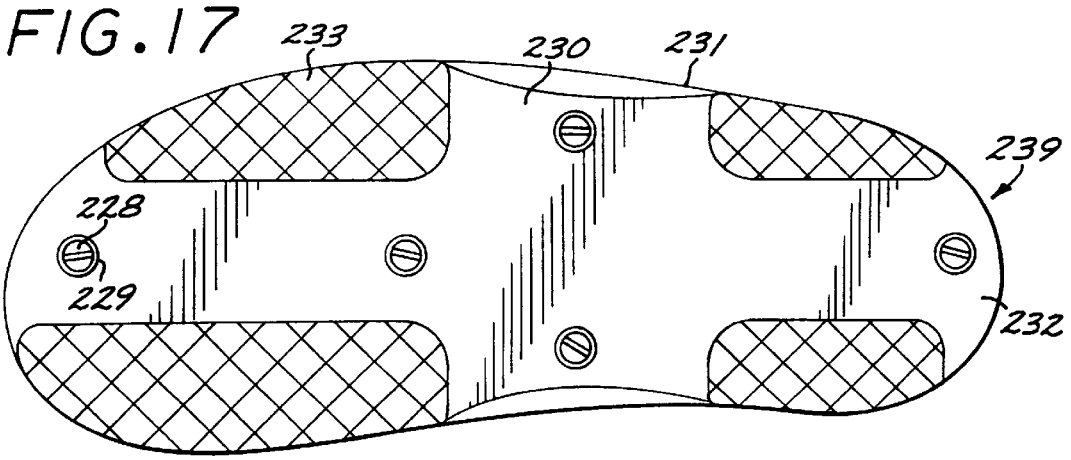
FIG. 17 is a bottom view of grinding footwear apparatus incorporating a ninth embodiment of the present invention.

The embodiments disclosed previously include concaved sliding surfaces that extend laterally across the sole of the particular article of footwear. However, it will be understood by those skilled in the art that there is no limitation upon the configuration of the sliding surface other than those imposed by the requirements of grinding. The shape of the sliding surface may thus be so as to traverse the sole of the shoe latitudinally or longitudinally or, as illustrated in FIG. 17, both latitudinally and longitudinally. The shoe depicted in FIG. 17 is equipped with a recessed slide plate 231 comprising a sliding surface 230 that extends latitudinally across the arch of the sole 239 and a sliding surface 232 that extends longitudinally from the mid-toe region to the mid-heel region and intersects the latitudinal sliding surface 230 in the arch area of the sole. The remaining exposed bottom surface of the sole is formed with high friction, coplanar surfaces 233 that engage the ground during the normal gait cycle. The slide plate 231 is mounted to the sole 239 of the shoe by threaded fasteners 228 that pass through countersunk bores 229 formed in the slide plate and threadingly engage inserts secured within the sole.

A shoe thus equipped allows the user the choice of sliding along a supporting protuberance facing sideways or facing forward. Alternatively, the user may engage one foot in a sideways stance and the other foot in a forward facing stance, thus placing herself in a stable position that allows switching to other positions conveniently without interruption of the sliding motion. It will be understood that a shoe that allows sliding while facing forward will also allow sliding while facing rearward.

Figure 18:
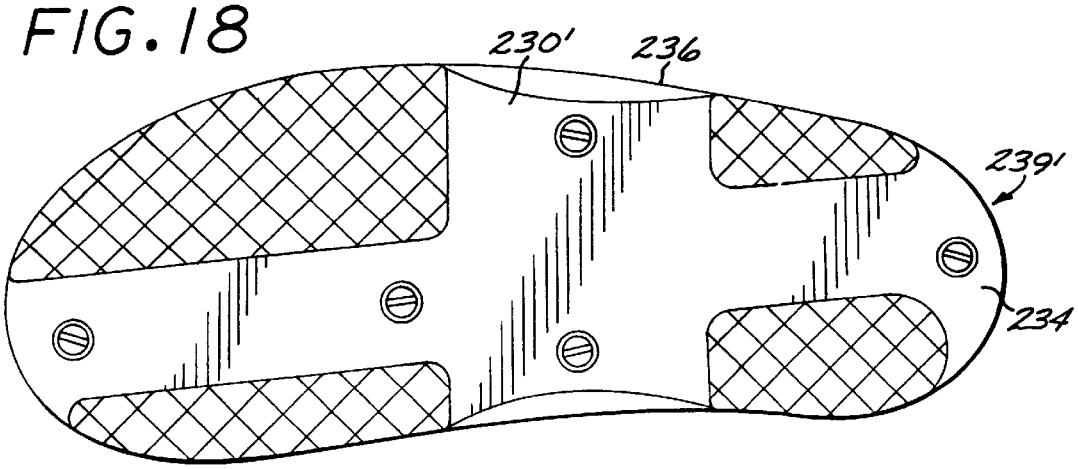
FIG. 18 is a bottom view of grinding footwear apparatus incorporating a tenth embodiment of the present invention.

Referring now to FIG. 18, a variation of the cross-shaped slide plate disclosed above comprises a slide plate 236 whose longitudinal sliding surface 234 is formed diagonally across the shoe sole 239' and extends from the big toe region to the outer heel region and intersects the latitudinal sliding surface 230' in the arch region of the sole. Alternatively, the longitudinal sliding surface may extend from the outer toe region to the inner heel region. These variations differ in the amount of ankle twist experienced by the user while employing the switch stance described above, and thus allow users to select the configuration best suited to their physiological needs as well as their intended application.

Figure 19:
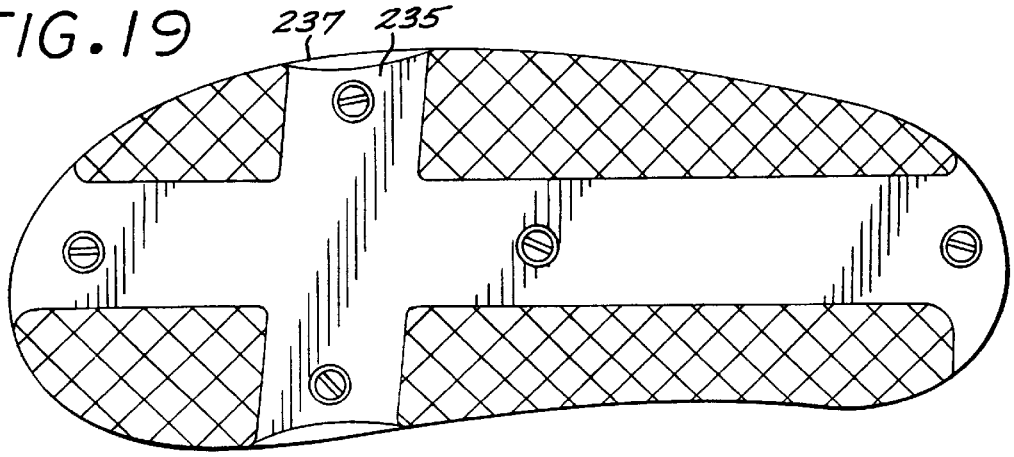
FIG. 19 is a bottom view of grinding footwear apparatus incorporating a eleventh embodiment of the present invention.

Another embodiment of a cross-shaped slide plate according to the present invention is illustrated in FIG. 19, wherein the slide plate 237 is formed with a latitudinal sliding surface 235 that extends across the ball, as opposed to the arch, of the foot. This configuration allows the user to support her weight during a sideways grinding maneuver with the ball of her foot and thus reduce considerably the stress experienced by the arch of her foot. This is an important consideration for a large segment of the population that suffers from misformed arches as well as other foot ailments.

Figure 20:
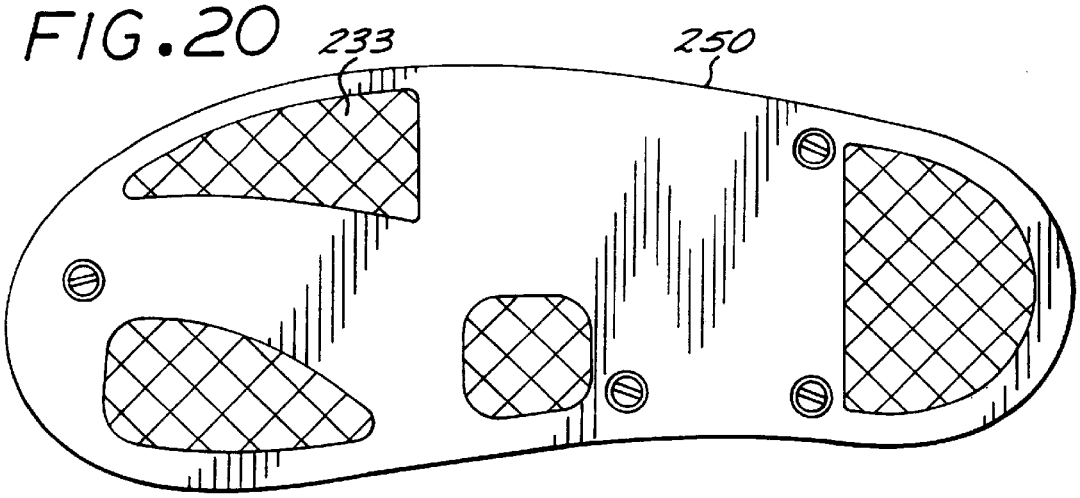
FIG. 20 is a bottom view of grinding footwear apparatus incorporating an twelfth embodiment of the present invention.

FIG. 20 illustrates an embodiment that maximizes the sliding area of the shoe sole while providing the minimum amount of high friction surface 233' necessary for supporting the foot and engaging the ground during a sustained walking or running gait. Protruding high friction, ground engaging areas 233' are thus provided in the heel, ball, and toe regions of the foot, and the remainder of the sole's bottom is covered by a recessed, low friction slide plate 250. This configuration permits the user to orient her feet in a variety of directions while sliding across a supporting surface, and also allows her to rotate across the supporting surface while sliding along it, executing in essence a sliding pirouette. This ability bestows upon the user significantly enhanced flexibility and increases her level of enjoyment as well as her safety by allowing rapid switching to whatever stance is most appropriate for each section of a non-uniform sliding surface.

Figure 21:
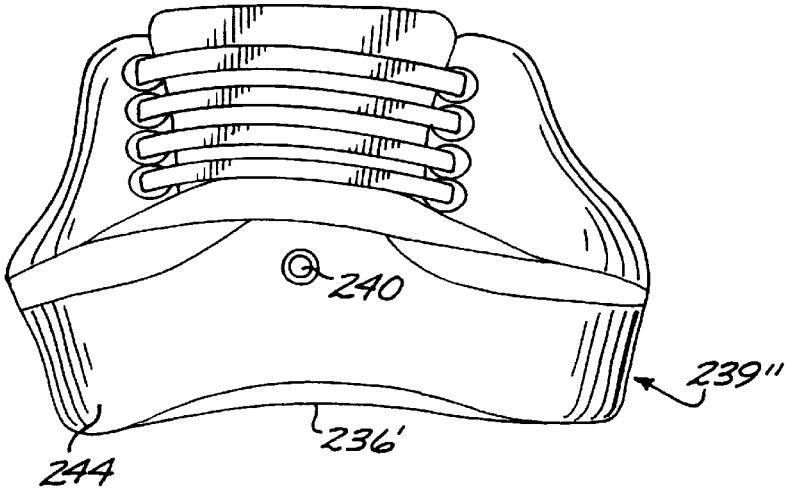
FIG. 21 is a front view of grinding footwear apparatus incorporating a thirteenth embodiment of the present invention.
Figure 22:
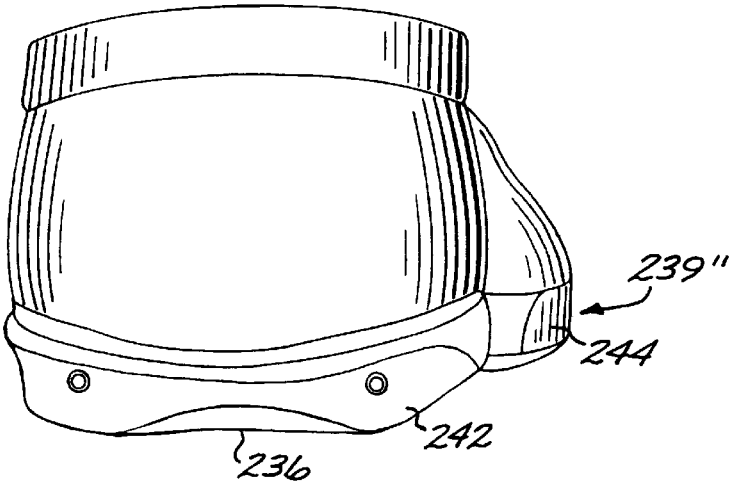
FIG. 22 is a rear view of the grinding footwear apparatus depicted in FIG. 17.

It is very important to note that the present invention is not limited to providing sliding surfaces on the bottom side of the sole of an article of footwear. Low friction sliding surfaces may also be formed on the sides of the sole, as illustrated in FIGS. 21 and 22 where a shoe apparatus having a recessed slide plate 236' in the bottom of its sole 239" also includes low friction slide elements attached along the side walls of the sole. The embodiment as illustrated includes a lateral slide element 244 attached around the perimeter of the toe region of the sole and a lateral slide element 242 attached around the perimeter of the heel region of the sole. Alternatively, the toe and heel lateral slide elements 244 and 242 may be formed as one single continuous element that overlies the side walls of the entire shoe sole 239".

Lateral sliding elements must retain the interchangeable nature of the bottom sliding elements disclosed previously, and therefore must be fastened in a secure but removable manner to the side walls of the shoe sole 239". The preferred fastening method employs threaded fasteners 240 that pass through bores formed in the lateral sliding elements 242 and 244 and threadingly engage the inner threads of inserts mounted within the side walls of the sole. The bores in the lateral sliding elements are preferably countersunk to accept the heads of the fasteners therein and protect them from coming into contact with the supporting surface. The heads of the fasteners may be formed with cavity to permit rotational engagement of the fasteners with tools such as hex wrenches or screwdrivers, and may also be formed with the trade name or logo of the manufacturer. If the aesthetics of the fastener head are not appealing to the users, opaque plugs that fit into the recess and cover the head may be used. The plugs must also be recessed from the supporting surface to prevent abrasive damage, and may also be formed with trademarks and logos upon their exposed side. As previously described, self locking fasteners such as Nylock® are preferred for use in this application.

An alternative fastening method employs hooked tabs formed on the inner side of the lateral sliding elements 242 and 244 that lockingly engage complementary shaped receiving chambers formed in the side walls of the shoe sole 239". The tabs must be sufficiently flexible to bend as the lateral sliding element is forced against the side wall of the sole during installation, but must also have sufficient mechanical strength to withstand the forces exerted upon it over the expected lifetime of the sliding element. When the sliding element must be removed, a screwdriver or similar object is inserted between the sliding element inner surface and the side wall of the sole and the hooked tabs are pried out of the receiving chambers.

The configuration for a grinding shoe described above allows the user to slide along a multi-sided supporting surface such as a V-shaped groove by engaging both the bottom and the lateral sliding surfaces of her shoe, and also allows further creative freedom in developing new grinding maneuvers such as sliding along the toes or the heels. Furthermore, lateral sliding surfaces also permit the user to slide along flat supporting surfaces such as sidewalks, thus obviating the need for a protrusion in the supporting surface and greatly expanding the range of grinding possibilities to practically any surface of sufficient stiffness and strength.

Figure 23:
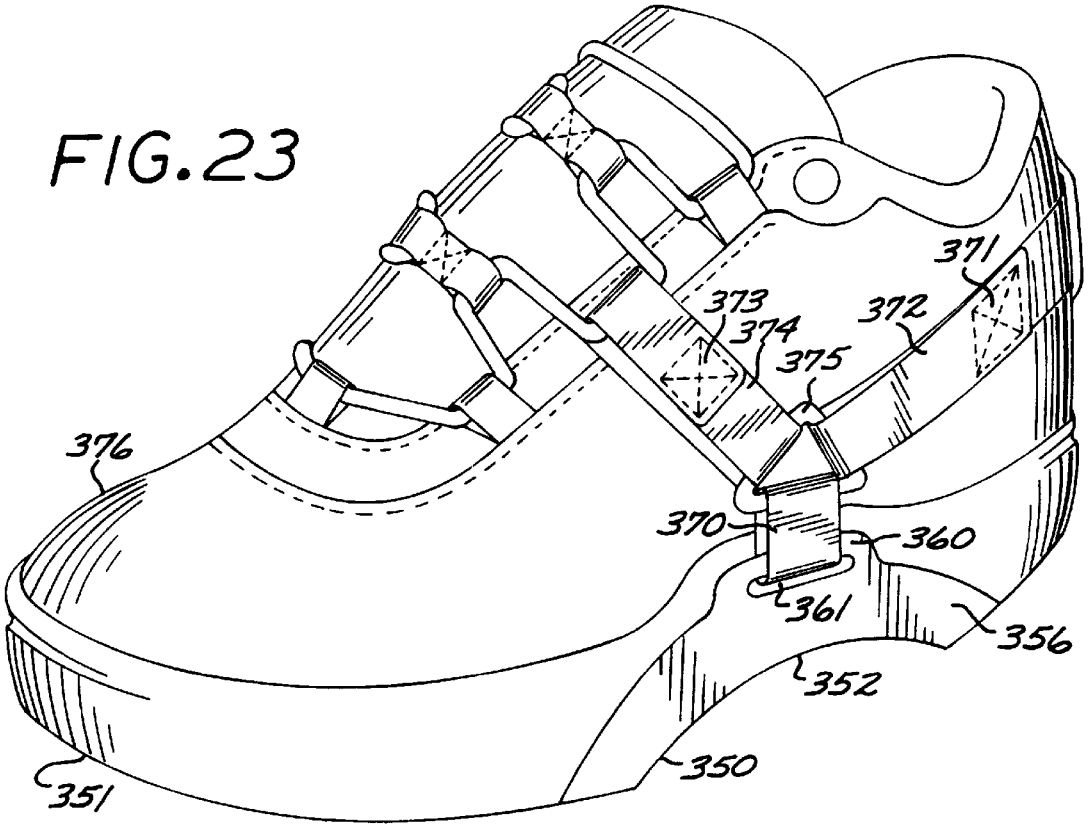
FIG. 23 is a perspective view of grinding footwear apparatus incorporating a fourteenth embodiment of the present invention.

All of the foregoing embodiments include removable slide plates, but require some rudimentary tools, whether a screwdriver, a knife, or a coin, to disengage the respective fasteners and remove the slide plate. It is foreseeable that the need may arise for a slide plate design employing a fastening system that requires absolutely no tools for removal and replacement, and is even quicker and easier to operate. One such alternative fastening system is shown in FIG. 23, wherein a shoe has an upper 376 attached to a sole 351 formed with a downward facing cavity in the arch region and receiving a slide plate 350 therein. The slide plate has a downward facing, concaved, substantially semi-cylindrical low friction trough 352 and is formed with laterally disposed upturned flanges 356. The flanges include a centrally disposed, upwardly facing tab 360 with a horizontal slot 361 therethrough.

A loop of webbing 370 passes through each slot 361 and through a triangular member 375 held in tension above each tab. 360 A strap 374 equipped with hook-and-loop fasteners 373 also passes through each triangular member 375 and engages the laces on either side of the shoe. One heel strap 372 equipped with hook and loop enclosures 371 passes through both triangular members and around the rear of the shoe. In this manner each triangular member 375 receives three straps 370, 372 and 374, each of which engages one side of the member.

In operation, the user may select a slide plate 350 with the desired characteristics and which has webbing loops 370 and triangular members 375 permanently, or alternatively removably, attached thereto. The user may then place the slide plate 350 in the cavity of the sole 351, loop a strap 374 through each triangular member 375 and the laces of the shoe, loop a heel strap 372 through each member and around the rear of the shoe, then adjust the tension in the three straps and engage their hook-and-loop fasteners to secure the slide plate within the sole cavity. It will be appreciated that this design allows very rapid removal, and almost equally rapid installation, of the slide plate 350. This feature may be extremely useful in circumstances where the user cannot or may not wear footwear for grinding. In addition, the need for any tools to remove the slide plate is eliminated, greatly enhancing the convenience of using the slide plates of the present invention.

Figure 24:
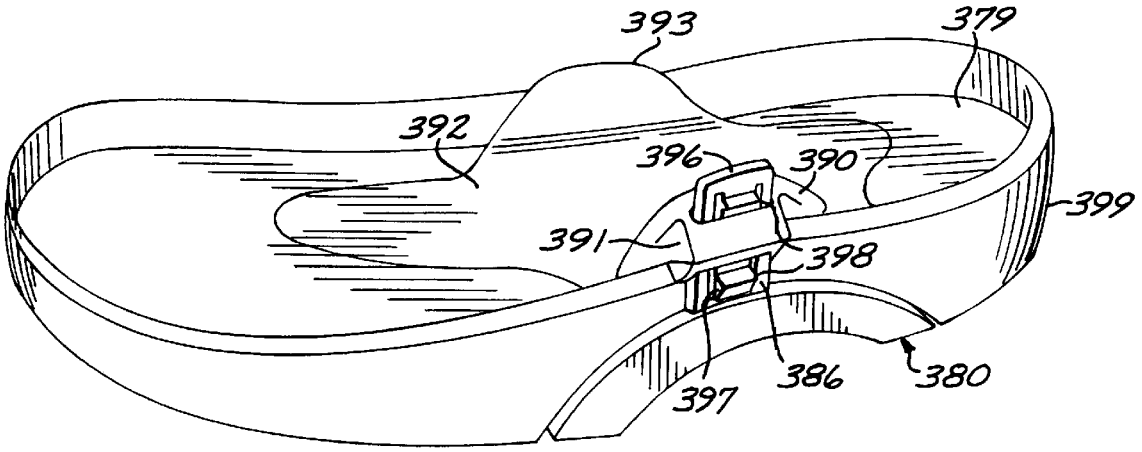
FIG. 24 is a perspective view of a sole for grinding shoe apparatus incorporating a fifteenth embodiment of the present invention.

In an alternative embodiment having one of a variety of potential quick release mechanisms, a quick release slide plate, as shown in FIG. 24, the cup 379 of the sole 399 receives an overlying mount anchor plate 392 formed with laterally disposed, upturned flanges 393 that rise above the upper edge of the sole and are exterior to the upper of the shoe. A mount 390 is formed on the upper end of each flange 393 and includes a bridge 391 that defines an upright slot with an inner serration. The slide plate 380 of the present embodiment is formed with tabs 396 extending upwardly from laterally disposed upturned flanges 386. Each tab 396 is formed with an inner rectangular opening and a tongue 397 maintained within the opening and flexibly connected to the tab at one end of the opening. The tongues 397 are configured with outwardly facing teeth 398 sized to engage the inner serration of the mounts 390.

In operation the user may insert the tabs 396 of the slide plate 380 through the corresponding mount 390 until the slide plate is fully received within the cavity of the shoe sole 399. As the tongue teeth 398 pass by the inner serrations of the mounts 390 a click sound is emitted, thereby assuring the user that the slide plate 380 is properly inserted and secured to the shoe. The use of an anchor plate 392 to secure the mounts 390 to the shoe is beneficial because the need to secure the mounts to the upper of the shoe is avoided, thereby preventing undue stress and premature damage to the shoe upper. The slide plate of the present embodiment is very easily attached to the shoe, and once the upper end of each tab 396 has been inserted into the corresponding mount 390, the user may simply step down on the shoe and force the shoe to slide down onto the slide plate. Once inserted to their furthest extent, the tongues 397 are secured within the mounts 390 by the inner serrations which engage and secure the tongue teeth 398. To remove the slide plate 380, the user will push in the free end of each tongue 397 with the fingers of one hand and then pull the slide plate down and away from the sole 399. The design of the present embodiment therefore allows the user to insert and remove each slide plate with one hand in a single, quick motion. Another benefit afforded by the present design manifests itself in the form of additional lateral support provided by the upturned flanges 393 of the mount anchor plate 392, which reach past the top of the sole 399 and thereby provide a saddle for the receipt and support of the users foot therebetween.

Figure 25:
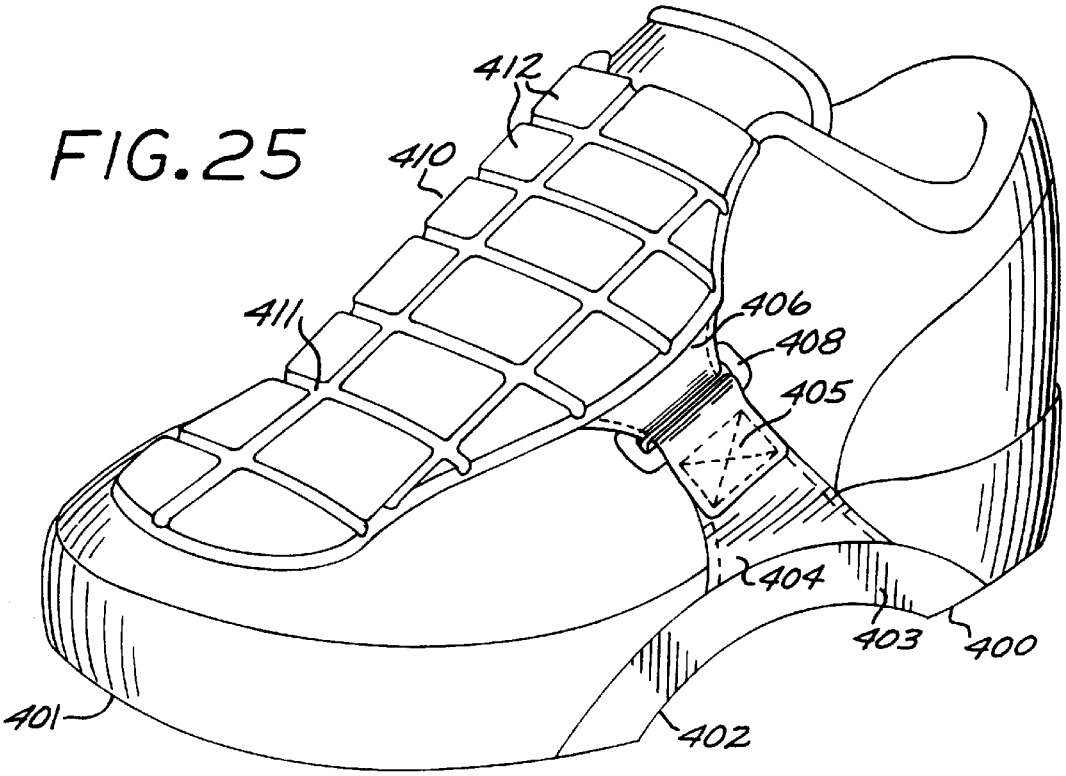
FIG. 25 is a perspective view of grinding footwear apparatus incorporating a sixteenth embodiment of the present invention.

It must be appreciated that the practice of the present invention need not be limited solely to slide plates mounted to the sides and bottom of footwear, but may be equally adaptable to the upper of a shoe. As illustrated in FIG. 25, an alternative embodiment of a shoe according to the present invention includes an upper attached to a sole 401 formed with a cavity receiving a slide plate 400 therein. The slide plate is formed with a downward facing, substantially semicylindrical, concaved, low friction trough 402 and laterally disposed, upturned flanges 403. Attached to each flange 403 is a strap 404 equipped with hook and loop fasteners 405. An instep slide plate 410 shaped to conform substantially to the instep surface of the upper is located over the instep of the shoe. The instep slide plate 410 is formed with an upper surface configured with low friction, flat surfaced protrusions 412 overlying a flexible substrate 411. A loop of webbing 406 is attached to each side of the instep slide plate 410 and passes through a D-ring 408.

In practice, the user will select a slide plate 400 and an instep slide plate 410, then mount them to her shoe by placing the slide plate within the sole cavity and the instep slide plate over the instep area of the shoe, then looping the slide plate straps 404 through the D-rings 408 and fastening the straps with the hook and loop fasteners 405 to tightly secure the two slide plates to the shoe. The addition of the instep slide plate 410 does not interfere with the user's normal gait because the flexible substrate 411 of the plate flexes in a concave configuration with each step of the user. When desiring to engage in grinding activities, the user may perform all grinding maneuvers described and alluded to previously, as well as novel maneuvers enabled by the addition of sliding surfaces to the upper of the shoe. For instance, the user may engage a pipe rail with the slide plate 400 of the leading shoe and the instep slide plate 410 of the trailing shoe by bending her trailing knee to or below the level of the pipe rail. The stance may be reversed, where the instep slide plate 410 leads and the slide plate 400 trails. Alternatively, the user may ride two rails simultaneously by engaging one rail with the slide plate 400 of one shoe and the other rail with the instep slide plate 410 of the other shoe and assuming a sideways stance between the two rails. As evidenced by the foregoing, the provision of an instep slide plate raises the level of athletic enjoyment of the user and expands the range of possible maneuvers.

Figure 26:
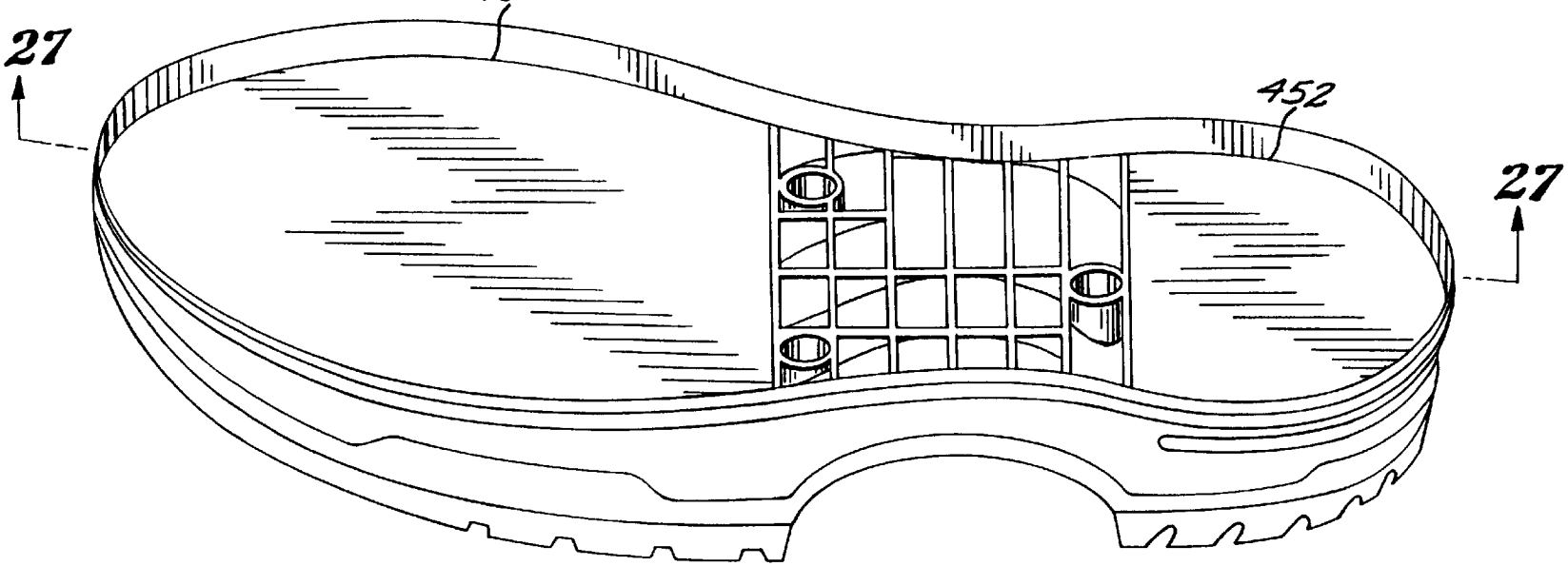
FIG. 26 is a perspective view of a shoe sole incorporated in a further embodiment of the present invention.
Figure 27:
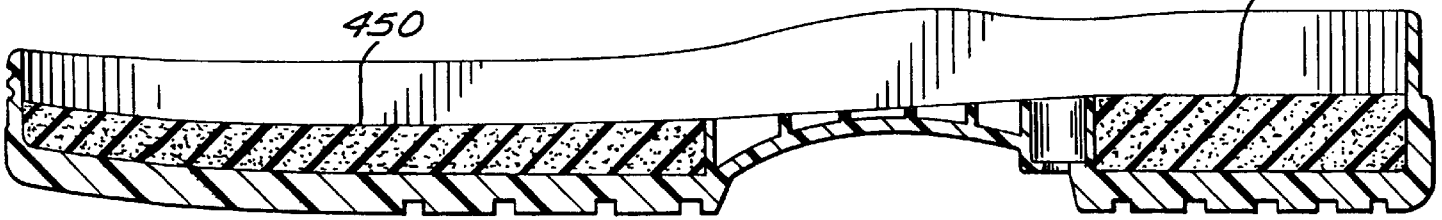
FIG. 27 is a longitudinal sectional view of the shoe sole shown in FIG. 26.

Referring to the shoe shown in FIGS. 26 and 27, a further embodiment of the grinding shoe of the present invention includes a shoe sole, generally designated 449, configured at the posterior extremity with an upwardly opening generally semi-cylindrically shaped heel pocket 451 and at its forward extremity with an upwardly opening forefoot pocket 453. Received in the respective pockets 451 and 453 are respective complementally shaped shock absorption insert pads 452 and 450 which may be of closed foam construction for efficient absorption of impact forces. The sole 449 is formed medially with a gridwork, generally designated 459, to afford lightweight structural support in the arch area. Consequently, in use a slide plate may be secured to the underside of the sole 449, with the upper attached to such sole, the user can perform grinding activities. It will be appreciated that an insole will typically overlie the cushion inserts 450 and 452 and that, from a dynamic landing force, the inserts will serve to absorb certain of such forces thus minimizing any tendency for injury of the bone structure in the foot of the user.

It will be appreciated by those skilled in the art that the present invention is not limited to providing sliding elements that are removably attached to articles of footwear. Any method may be used to provide an article of footwear with low friction surfaces, and may include forming the sliding surfaces integral to the sole during the extrusion molding process, or alternatively may consist of sintering low friction material into certain regions of the sole. The use of such permanent, non-removable sliding surfaces is highly dependent upon the ready availability of materials of sufficient durability to withstand repeated sliding across abrasive surfaces for the expected lifetime of the article of footwear. Such materials tend to be difficult to process and costly, and it is for this reason that the preferred embodiments disclosed herein include removable slide elements.

From the foregoing, it will be appreciated that the apparatus of the present invention facilitates performing the acrobatic maneuvers popularly known as grinding by enabling a person wearing shoes adapted for traditional purposes such as wailing or running to engage a protruding feature on a supporting surface and slide across such protuberance on low friction surfaces formed on the shoes in selected configurations. The low friction sliding surfaces of the present invention are formed integral to the shoes or attached thereto as removable sliding elements, and are equally adaptable to athletic, work, or recreational footwear of all types and styles. A feature of particular significance resides in the fact that the sliding surfaces of the present invention do not interfere with the traditional functions of footwear and do not require the user to adjust her normal walking or running gait when wearing shoes equipped with such sliding surfaces. The apparatus of the present invention therefore adapts specialized equipment to traditional footwear and thereby enlarges the usefulness of such footwear and the enjoyment level of persons wearing it. The present invention can also be implemented in a wide range of aesthetic and practical choices for design and manufacturing, and can thus be adapted to appeal to diverse markets and consumers.

While a particular embodiment of the invention has been illustrated and described, various modifications can be made without departing from the spirit and scope of the invention, and all such modifications and equivalents are intended to be covered.

What is claimed is:

1. An article of footwear for sliding along a support surface and comprising:

an elongated sole configured with a downwardly facing sole surface and having an arch area formed with an arch recess section raised upwardly therein from said tread surface and a raised longitudinal recess section extending longitudinally from said arch area; and a grind plate configured with an arch plate and a longitudinal plate section formed on their respective top sides to be complementally received in the respective said arch and longitudinal recess sections and having respective downwardly facing low friction slide surfaces.

2. An article of footwear according to claim 1 wherein:

the lowermost extent of said plate sections, when nested within the respective recesses, are disposed above a horizontally disposed plane through the lowermost extent of said sole surface.

3. An article of footwear according to claim 1 wherein:

said grind plate is constructed of plastic.

4. An article of footwear according to claim 1 wherein:

said grind plate is cruciform shaped in bottom plan view.

5. An article of footwear according to claim 1 wherein:

said longitudinal plate section is concaved upwardly in transverse cross section.

6. An article of footwear according to claim 1 wherein:

said longitudinal plate section is flexible.

7. An article of footwear as set forth in claim 1 wherein:

said plate includes a toe plate turned upwardly at the front tip of said sole.

8. An article of footwear as set forth in claim 1 wherein:

said sole is formed with said recess extending forwardly under the toe area of said sole; and said plate includes a toe plate section in said recess under said toe area.

9. An article of footwear as set forth in claim 8 wherein:

said sole is formed with said recess extending rearwardly under the heel area of said sole;

said plate includes a heel plate section in said recess under said heel area;

said plate further includes toe and heel plates turned upwardly, respectively, at the respective toe and heel ends of said sole and is further formed with an arch plate section projecting to the lateral sides of said sole and turned upwardly to form outwardly facing, upwardly and outwardly inclined slide surfaces.

10. An article of footwear as set forth in claim 1 wherein:

said sole is formed with said recess extending rearwardly under the heel area of said sole; and said plate includes a toe plate section in said recess under said heel area.

11. An article of footwear as set forth in claim 10 wherein:

said plate includes a heel plate turned up at the back of the heel of said sole.

12. Grind shoe apparatus comprising:

a shoe having a flexible shoe sole device including a downwardly facing tread surface and formed with a longitudinally extending downwardly opening recess; and a flexible grind plate in said recess configured to be recessed upwardly in said recess above a plane including the lowermost extent of said tread surface and formed with a downwardly facing low friction grind surface for grinding along an underlying support surface.

13. Grind shoe apparatus as set forth in claim 12 wherein:

said grind plate is configured to form said grind surface convex in transverse cross section.

14. Grind shoe apparatus as set forth in claim 12 wherein:

said shoe sole is formed with said recess cruciform shape; and said grind plate is cruciform shaped in bottom plan view.

15. Grind shoe apparatus as set forth in claim 12 wherein:

said longitudinal plate section spans substantially to the back of the heel.

16. Grind shoe apparatus as set forth in claim 15 wherein:

said longitudinal plate section spans substantially to the tip of the toe.

17. Grind shoe apparatus as set forth in claim 12 wherein:

said longitudinal plate section spans substantially to the tip of the toe.

18. Grind shoe apparatus as set forth in claim 12 wherein:

said plate projects laterally to at least one side of the heel of said sole and wraps up on the sides thereof.

19. Grind shoe apparatus as set forth in claim 12 wherein:

said plate includes an edge section along at least one side of the forefoot of said soles wrapping upwardly along the edge thereof.

20. Grind shoe apparatus as set forth in claim 12 wherein:

said plate includes a heel section wrapping up about the back edge of the heel of said sole.

21. Grind shoe apparatus as set forth in claim 12 wherein:

said plate includes a heel section disposed on one side of the heel of said sole and wrapping upwardly about the edge thereof.

22. Grind shoe apparatus as set forth in claim 12 wherein:

said plate includes a peripheral section extending about the periphery of said sole.

23. Grind shoe apparatus as set forth in claim 22 wherein:

said peripheral section wraps upwardly about the peripheral edge of said sole.

24. Grind shoe apparatus as set forth in claim 12 wherein:

said recess is formed on the lateral underside of said sole.

25. Grind shoe apparatus as set forth in claim 12 wherein:

said recess is formed along the lateral underside of said sole.

26. Grind shoe apparatus as set forth in claim 12 wherein:

said recess projects diagonally from the heel toward the toe of said sole.

27. Grind shoe apparatus as set forth in claim 26 wherein:

said recess projects the full length from the back of said heel to the tip of said toe.

28. Grind shoe apparatus as set forth in claim 26 wherein:

said recess angles from the lateral side of said heel to the medial side of said forefoot section.

29. Grind shoe apparatus as set forth in claim 26 wherein:

said recess angles from the medial side of said heel toward the lateral side of said forefoot section.

30. Grind shoe apparatus as set forth in claim 29 wherein:

said plate projects throughout the length of said recess.

31. Grind shoe apparatus as set forth in claim 26 wherein:

said plate projects throughout the length of said recess.

32. Grind shoe apparatus as set forth in claim 12 wherein:

said plate includes a ball section projecting laterally across the ball of said forefoot.

33. Grind shoe apparatus as set forth in claim 12 wherein:

said plate projects longitudinally down the center of said sole.

34. Grind shoe apparatus as set forth in claim 33 wherein:

said plate projects transversely across the arch of said sole and about the periphery thereof.

35. Grind shoe apparatus as set forth in claim 12 that includes:

bonding means bonding said plate to said sole.

36. Grind shoe apparatus as set forth in claim 12 that includes:

mechanical means fastening said plate to said sole.

37. Grind shoe apparatus as set forth in claim 12 that includes:

said sole molded to affix said plate thereto.

38. Grind shoe apparatus as set forth in claim 12 wherein:

said grind plate is constructed of plastic.

39. Grind shoe apparatus as set forth in claim 12 wherein:

said sole includes an outsole and cushioning in the forefoot and heel sections.

40. Grind shoe apparatus as set forth in claim 1 wherein:

said grind plate is turned up on at least one lateral side.

41. Grind shoe apparatus as set forth in claim 1 wherein:

said grind plate is turned upwardly at both lateral sides.

42. An article of footwear for sliding along a support surface and comprising:

a sole configured with a downwardly facing tread surface formed with an upwardly raised longitudinal recess section above extending longitudinally; and a grind plate fastened to said sole and configured with a longitudinal plate section formed on its top side to be complementally received in said longitudinal recess sections and having a bottom side concave upwardly in transverse section to accept said support surface.

43. A method of manufacturing an article of footwear including:

fabricating a shoe with a sole having a downwardly facing tread surface forming said sole with an upwardly raised, longitudinally projecting recess;

forming a grind plate on its top side to complementally fit in said recess to project longitudinally in said recess and formed on its bottom side with a longitudinal slide surface for sliding on an underlying support surface; and fastening said grind plate to said sole.

44. A method as set forth in claim 43 that includes:

forming said sole with longitudinal and transversely extending recess sections; and;

said forming step for said grind plate includes forming said grind plate with a longitudinal extending grind plate section and a transversely extending grind plate section for selectively sliding longitudinally on a support surface or transversely on a support surface.

45. A method as set forth in claim 43 that includes:

forming said grind plate so that when it is mounted in said recess it is recessed sufficiently far upwardly therein so that the lower extent thereof is above said sole tread surface.

46. The article of said footwear as set forth in claim 42 wherein:

said grind plate includes a transverse plate section projecting transversely of said sole for sliding laterally on a support surface.

47. An article of footwear as set forth in claim 42 wherein:

said grind plate includes a section extending transversely under the ball area of said sole for sliding transversely on an underlying support surface.

48. An article of footwear for sliding along a support surface and comprising:

a sole configured with a downwardly facing sole surface having heel and forefoot areas separated by an arch area and formed in said arch area with an arch recess section and a longitudinal recess section extending longitudinally from said arch recess section, said recess sections being raised upwardly from the level of said sole surface; and a grind plate configured with arch plate and longitudinal plate sections formed on their respective top sides to be complementally received in the respective said arch and longitudinal recess sections and having respective downwardly facing low friction slide surfaces.

49. An article of footwear for sliding along a support surface and comprising:

an elongated sole configured with a downwardly facing sole surface having an arch recess section formed therein and a raised longitudinal recess section extending longitudinally from said arch recess section, said sections raised upwardly from the level of said sole surface; and a grind plate configured with arch plate and longitudinal plate sections formed on their respective top sides to be complementally received in the respective said arch and longitudinal recess sections, said longitudinal plate section formed on its bottom side with a concave in transverse section slide surface.

* * * * *